US012662926B2

(12) United States Patent
Luo et al.

(10) Patent No.: US 12,662,926 B2
(45) Date of Patent: Jun. 23, 2026

(54) DETECTION OF FLUID LOSSES OR GAINS IN MANAGED PRESSURE DRILLING OPERATIONS

(71) Applicant: Halliburton Energy Services, Inc., Houston, TX (US)

(72) Inventors: Yan Luo, Carrollton, TX (US); Muran Han, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 67 days.

(21) Appl. No.: 18/738,857

(22) Filed: Jun. 10, 2024

(65) Prior Publication Data

US 2025/0146401 A1 May 8, 2025

Related U.S. Application Data

(63) Continuation-in-part of application No. 18/387,283, filed on Nov. 6, 2023.

(51) Int. Cl.
*E21B 44/00* (2006.01)
*E21B 21/08* (2006.01)

(52) U.S. Cl.
CPC ..... *E21B 44/00* (2013.01); *E21B 21/08* (2013.01)

(58) Field of Classification Search
CPC ..... E21B 21/08; E21B 44/00
See application file for complete search history.

(56) References Cited

U.S. PATENT DOCUMENTS 8,256,532 B2 9/2012 Gray
9,482,084 B2 11/2016 Chang et al.
(Continued)

FOREIGN PATENT DOCUMENTS

WO 2014066430 A2 5/2014
WO 2016040310 A1 3/2016
WO 2018005567 A1 1/2018

OTHER PUBLICATIONS

Filing Receipt, Specification and Drawings for U.S. Appl. No. 18/387,283, entitled, "Improved Influx and Loss Detection for Managed Pressure Drilling Operations," filed Nov. 6, 2023, 67 pages.
Jin et al., "A Field Case Study of Managed Pressure Drilling in Offshore Ultra High-Pressure High-Temperature Exploration Well in the South China Sea," SPE-191060-MSat the IADC/SPE Asia Pacific Drilling Technology Conference and Exhibition, Bangkok, Thailand, Aug. 27-29, 2018. pp. 503-524.
(Continued)

*Primary Examiner* — Tara Schimpf
*Assistant Examiner* — Lamia Quaim
(74) *Attorney, Agent, or Firm* — Conley Rose, P.C.; Rodney B. Carroll

(57) ABSTRACT

Disclosed embodiments relate to MPD well drilling methods, for example detecting fluid gains or losses even in transient conditions. For example, data relating to one or more parameter of the drilling system may be corrected/filtered using one or more technique. The corrected data can be used to calculate flowrate difference (DeltaFR), and possible fluid losses or gains in the system can be detected by calculating a virtual trip tank (VTT) using DeltaFR. In some embodiments, the technique can compensate for drill-string movement. In some embodiments, an adaptive moving average may be applied to the data to reduce noise. In some embodiments, bilateral filtering may be applied to the data, for example to address issues arising from movement of a choke in the drilling system. In some embodiments, updated baselines may be applied to remove any offset. Systems related to such methods are also disclosed.

19 Claims, 4 Drawing Sheets

(56) References Cited

U.S. PATENT DOCUMENTS

| | | | | |
|---|---|---|---|---|
| 9,708,898 | B2 | 7/2017 | Milner et al. | |
| 9,725,974 | B2 | 8/2017 | Lovorn | |
| 10,060,208 | B2 | 8/2018 | Gumus et al. | |
| 10,443,328 | B2 | 10/2019 | Culen | |
| 11,085,255 | B2 | 8/2021 | Fossli | |
| 11,149,508 | B2 | 10/2021 | Peveri | |
| 11,255,163 | B2 | 2/2022 | Nazhan | |
| 2014/0291023 | A1* | 10/2014 | Edbury | E21B 21/08 345/440.2 |
| 2015/0134258 | A1 | 5/2015 | Luppens et al. | |
| 2022/0056799 | A1 | 2/2022 | Johnson et al. | |
| 2022/0136379 | A1* | 5/2022 | Ba | E21B 47/00 702/2 |
| 2023/0135617 | A1 | 5/2023 | Gabaldon et al. | |
| 2023/0193742 | A1* | 6/2023 | Mammadov | E21B 44/00 166/250.15 |
| 2023/0243254 | A1 | 8/2023 | Converset et al. | |

OTHER PUBLICATIONS

Harpreet Kaur Dalgit Singh, "Using Managed Pressure Drilling Equipment to Troubleshoot Well Control Issues with Total Lost Circulation and Ballooning on A Semi-submersible Rig" SPE 205982-MS, 8 pages. Sep. 23, 2021 Dubuai, UAE.

* cited by examiner

Overall HS = (Σ Signal HS x Weights)

| Health Score (HS) (0-100) | Detection Threshold (gpm/s) | Confirmation Volume (bbl) |
|---|---|---|
| [85, 100] | 0.55 | 0.25 |
| [75, 85] | 1.0 | 0.50 |
| [65, 75] | 1.2 | 1.00 |
| [0, 65] | 1.5 | 2.00 |

FIG. 3

DETECTION OF FLUID LOSSES OR GAINS IN MANAGED PRESSURE DRILLING OPERATIONS

CROSS-REFERENCE TO RELATED APPLICATIONS

This application is a continuation-in-part of and claims priority to U.S. patent application Ser. No. 18/387,283, filed Nov. 6, 2023, the entire contents of which are incorporated herein by reference.

FIELD

The present disclosure relates generally to equipment used in operations which may be performed in conjunction with drilling a subterranean well, such as an oil or gas well, and more particularly to managed pressure drilling operations and associated equipment and techniques to better detect and address fluid losses or gains.

BACKGROUND

In drilling operations, controlling the flow of fluids in the well can be important, both for more effective operation of the well and for safety. For example, when drilling a well in a hydrocarbon rich-formation, if wellbore pressure (e.g. bottom hole pressure—BHP) is not maintained at a desired level, unwanted effects can lead to undesired results. For example, if wellbore pressure is not effectively controlled, there may be unwanted influx of formation fluids into the wellbore or excess loss of drilling fluid into the formation surrounding the wellbore. Influx (also known as "kick") is the flow of formation fluids into the wellbore during a drilling operation, while fluid loss can occur when drilling fluid in the wellbore enters the formation.

An influx into the wellbore can disrupt normal drilling operations and, if left unchecked, can lead to hazardous conditions. For example, if an influx is not detected and controlled effectively, the influx can escalate into an uncontrolled flow of formation fluids to the surface through the well (sometimes called a "blow-out"), which could result in operational delays in the drilling operation (e.g. non-productive time), damage to the drilling equipment, or even injury to personnel. The drilling system typically is designed to be able to safely handle smaller influxes, but larger influxes can overwhelm such a system, raising the risk of blowout. Typically, influx is controlled by effectively managing the pressure within the well. For example, wellbore pressure may be maintained at a desired level during drilling operations in order to prevent significant influx beyond the capabilities of the drilling system and to safely manage those influxes.

However, drilling a well is a dynamic operation which can have many transient conditions, such that the wellbore pressure may need to constantly be adjusted to maintain the desired balance (e.g. with wellbore pressure levels approximately balancing the formation fluid pressure, typically with wellbore pressure slightly greater than the pore pressure of the formation without exceeding the fracture pressure of the formation). This can be particularly challenging in formations with narrow pressure margins. Thus, there is a need to effectively detect changing wellbore pressures and mitigate influxes which can occur during drilling operations (for example, by adjusting the wellbore pressure quickly enough to minimize the influx and keep it at a small enough level so that the system can effectively address the influx without the need for a shutdown). Furthermore, to be effective, pressure management in the wellbore cannot simply account for steady-state wellbore conditions, but must be able to effectively detect the presence and size of influxes under more dynamic/transient conditions. Additionally, early kick detection can allow for more effective mitigation.

BRIEF DESCRIPTION OF THE DRAWINGS

Embodiments of the disclosure may be better understood by referencing the accompanying drawings.

FIG. 3 provides an illustrative example of a look-up table, which may be used within the system of FIG. 2 to provide adaptive detection threshold and detection sensitivity, according to an embodiment of the disclosure.

DESCRIPTION

Figure 1:
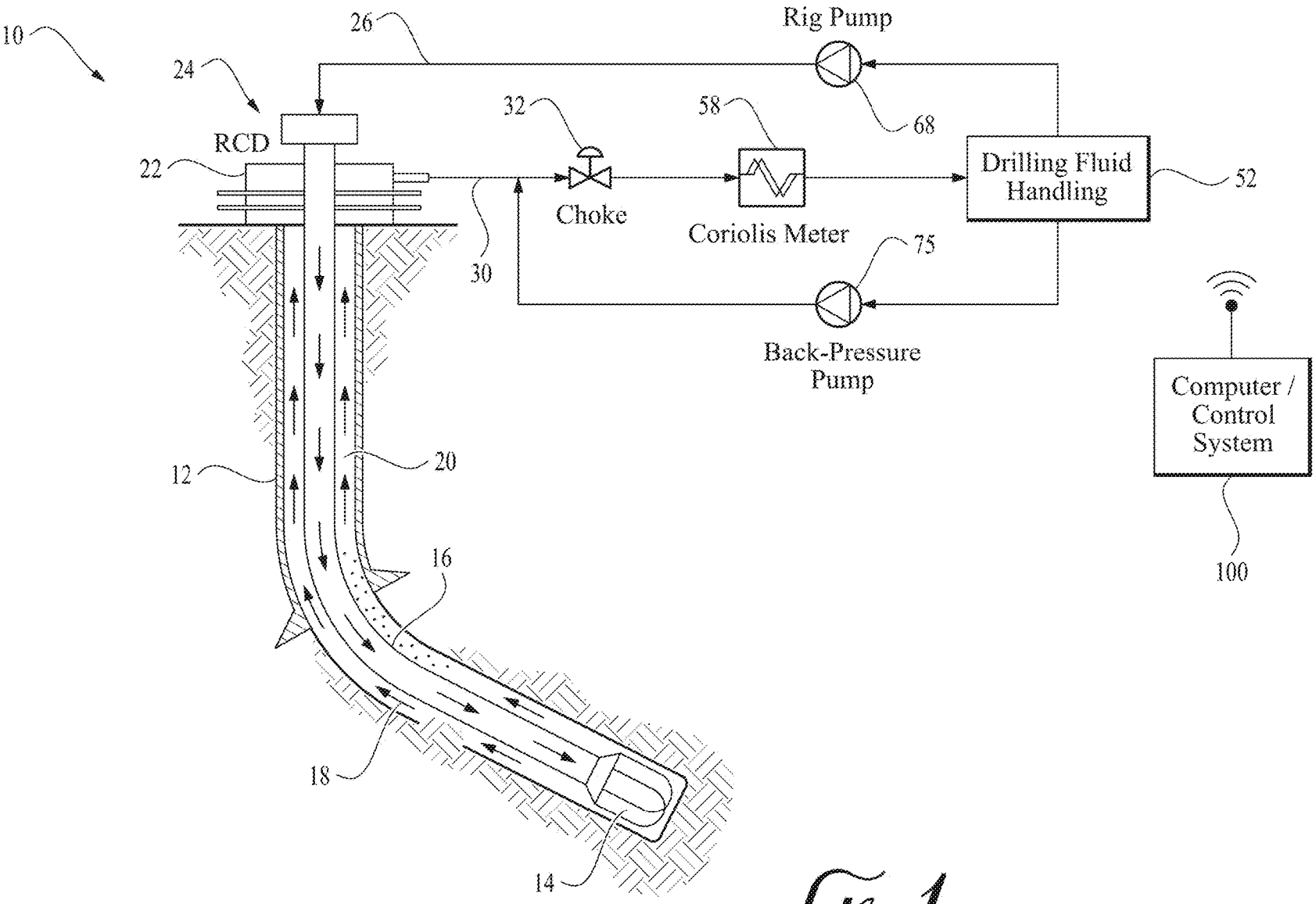
FIG. 1 illustrates schematically an exemplary MPD drilling system, according to an embodiment of the disclosure.

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid in the well casing. "Upstream" is directed counter to the direction of flow of well fluid, while "downstream" is directed in the direction of flow of well fluid, as persons of skill will understand.

During drilling operations, it can be crucial to maintain the bottom hole pressure (BHP) in the operational window at any depth in the open-hole section of the wellbore. If the BHP falls below the pore pressure of the formation, it can lead to the influx of formation fluids into the wellbore. By contrast, a loss can occur when the BHP is over the fracture pressure, with drilling fluid in the wellbore being lost to the formation, which can have detrimental effects. An uncontrolled influx can trigger a "blow-out", which has potentially catastrophic consequences.

Managed pressure drilling (MPD) is a type of drilling that uses a closed-loop system to control the annular pressure profile during the drilling operation. For example, an exemplary MPD system may use a rotating control device (RCD), an automatic choke, and one or more mud pumps to create a closed system with the drillstring and the well. MPD operators can use the RCD, choke, and pump to control annulus pressure in the well, for example to maintain an approximately constant BHP during drilling operations.

MPD systems can enable precise control of the annular pressure profile in the wellbore, allowing wells to be drilled more safely in formations with narrow pressure margins (e.g. when the margin between the pore pressure and the fracture pressure is relatively small). Exemplary MPD systems are typically closed-loop drilling systems, and may use an RCD, a choke manifold, and a pressurizable mud-return system to control wellbore pressure during drilling. Exemplary pressurizable mud-return systems may include a mud pump and standpipe line. MPD systems may also include one or more flow meter (such as a Coriolis meter) and a back pressure pump. MPD typically relies on the choke manifold (e.g. one or more choke) to apply back pressure on the annular side, to maintain the BHP approximately constant throughout the drilling operation. Additionally, the flow meter may enable early influx detection by constant monitoring of the difference between the return flow (e.g. the flow-out of the annulus) and the flow-in (e.g. flow into the drillstring). For example, a Coriolis flow meter can be used, due to its accuracy. Combined with immediate adjustment of back pressure by manipulating the choke (and/or using the back pressure pump if needed), the MPD system can allow small and medium size influxes to be safely circulated out of the well without needing a conventional shut-in process. However, early detection of influx (e.g. early kick detection (EKD) can be important to determine the appropriate action in order to effectively address the influx.

An exemplary well drilling system 10 is illustrated in FIG. 1. However, it should be clearly understood that the MPD system 10 and associated methods are merely examples of an application of the principles of this disclosure in practice, and a wide variety of other examples are possible. Therefore, the scope of this disclosure is not limited to the details of the system 10 and method described herein and/or depicted in the drawings. For example, while the drilling system 10 of FIG. 1 may include a wellbore 12 and a drillstring 16 disposed in the wellbore 12, in some embodiments, the system 10 may include equipment that may have various characteristics and features associated with an offshore platform, a land drilling rig, a drill ship, semi-submersibles, and/or drilling barges. Various types of drilling equipment such as the rotating control device (RCD) 22, blow out preventer (BOP), one or more mud pumps 68, one or more mud tanks, choke manifold 32, flow meters (such as Coriolis meter 58), connecting tubing/pipes (for example configured to provide fluid communication between various equipment/elements of the MPD system 10 and configured to withstand typical operating pressures for such as system), and/or any other suitable equipment may be located on the well surface and/or at the well site.

As shown in FIG. 1, for example, a wellbore 12 may be drilled by rotating a drill bit 14 on an end of a drill string 16. Drilling fluid 18, commonly known as mud, can be circulated downward through the drill string 16, out the drill bit 14 and upward through an annulus 20 formed between the drill string 16 and the wellbore 12, in order to cool the drill bit 14, lubricate the drill string 16, remove cuttings from the drilling process, and provide a measure of bottom hole pressure control. In embodiments, a non-return valve (typically a flapper-type check valve) can prevent flow of the drilling fluid 18 upward through the drill string 16 (e.g., when connections are being made in the drill string), for example with the drillstring being configured to only allow fluid flow downhole through the drillstring.

In the system 10, additional control over the wellbore pressure can be obtained by closing off the annulus 20 (e.g., isolating it from communication with the atmosphere and enabling the annulus 20 to be pressurized at or near the surface), for example using a rotating control device 22 (RCD). The RCD 22 seals about the exterior of the drill string 16, for example above a wellhead 24, isolating the annular space (e.g. to allow the annular space to the pressurized) while allowing the drillstring 16 to rotate and fluid to circulate (e.g. within the drillstring 16 and/or in the annular space (e.g. annulus 20) between the drillstring 16 and the surface/walls of the wellbore 12). The drill string 16 can extend out of the wellbore through the RCD 22 for connection to, for example, a rotary table, a standpipe line 26 (e.g. configured to provide pressurized mud to the drillstring, e.g. from a mud pump 68), a Kelly, a top drive and/or other conventional drilling equipment.

In embodiments, the RCD 22 may be in fluid communication with a choke manifold 32. The drilling fluid 18 exits the wellhead 24 (e.g. via a wing valve in communication with the annulus 20 below the RCD 22), and then flows through mud return line 30 to the choke manifold 32 (typically located in proximity to the RCD). In some embodiments, the choke manifold 32 may include a plurality of chokes, such as a series of redundant chokes in which only one might be used at a time. In some embodiments, the choke manifold 32 may comprise one or more adjustable choke (e.g. in which the amount of restriction is adjustable). In some embodiments, the choke manifold 32 may comprise an automatic choke, for example having a valve or series of valves operable to adjust the pressure of drilling fluid 18 in the well. Adjustments to well pressure may be based on adjusting the choke manifold 32, for example opening and closing one or more valves in such an automatic choke, and the one or more valves can be of any variety of styles, sizes and pressure ratings. In embodiments, the choke manifold 32 may be controlled by signals from a control system 100, control unit, or any other suitable control mechanism. For example, an automatic choke may be operated remotely via hydraulic actuators or operated via any other suitable method. Backpressure can be applied to the annulus 20 and managed by variably restricting flow of the fluid 18 through the operative choke(s) of the choke manifold 32.

In other examples, flow control devices other than chokes may be used (e.g. in the choke manifold) for applying backpressure to the annulus 20. The flow control device can be used to restrict flow or divert flow, so that the backpressure applied to the annulus 20 is regulated.

In the example of FIG. 1, the greater the restriction to flow through the choke manifold 32, the greater the backpressure (e.g. also termed surface backpressure or "SBP") applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20. Typically, a control system 100 (which may be computerized and/or may operate based on software, for example) may manage the pressure by monitoring pressure and/or other parameters using one or more sensors and adjusting backpressure (for example, via the choke manifold 32). In some embodiments, a hydraulics model can be used to determine a pressure to be applied to the annulus 20 at or near the surface which will result in a desired downhole pressure, so that an operator (which may be an automated control system in some instances) can readily determine how to regulate the pressure applied to the annulus 20 at or near the surface (which can be conveniently measured) in order to obtain the desired downhole pressure.

In FIG. 1, the choke manifold 32 is in fluid communication with a drilling fluid handling system 52. The MPD system 10 is configured so that drilling fluid 18 from the wellbore 12 can flow through the choke manifold 32 to the drilling fluid handling system 52, which may for example comprise one or more mud pit/mud tank/trip tank and/or one or more mud gas separator. The mud pits/trip tanks may be used to store drilling fluid 18 circulating through the system 10, for example providing temporary storage of drilling fluid (for example sufficient to handle a small influx). In embodiments, mud pits/trip tanks may comprise one or more open-top containers, for example made of steel or other suitable material. The amount of drilling fluid in the mud pits/trip tanks may be monitored and communicated to personnel, control system 100, or other suitable control mechanism. Additionally, in some embodiments mud pits/trip tanks may include temperature sensors, pressure sensors, filters, alarms, flow rate meters, and/or any other equipment suitable for monitoring, maintaining, and controlling drilling fluid in the mud pits/trip tanks.

In addition to being in fluid communication with the choke manifold 32, the drilling fluid handling system 52 of FIG. 1 is also in fluid communication with one or more mud pumps 68. For example, from the drilling fluid handling system 52, drilling fluid 18 may be directed either to the rig mud pump 68 (e.g. to be pressurized for insertion back into the drillstring) or (for example if needed to control fluid flow) to a backpressure pump 75, which then may pump the drilling fluid back into the mud return line 30 (e.g. at a location between the wellhead 24 and the choke manifold 32). For example, the backpressure pump 75 may be used to provide additional backpressure, for example if the choke manifold 32 alone cannot generate the required backpressure for the system.

The drilling fluid 18 is pumped through the standpipe line 26 and into the interior of the drillstring 16 (which passes into the wellbore 12 through the RCD 22) by the rig mud pump 68 (which is in fluid communication with the drilling fluid handling system 52 and the drillstring 16). The rig mud pump 68 receives the fluid 18 from the drilling fluid handling system 52 and flows it (for example via a standpipe manifold) to the standpipe line 26. The fluid 18 then can circulate downward through the drillstring 16, upward through the annulus 20, through the mud return line 30, through the choke manifold 32, and then to the drilling fluid handling system 52 for conditioning and recirculation (e.g. via the mud pump 68).

Mud pump 68 may include one or more pumps in various configurations. For example, mud pump 68 may include a plurality of pumps configured in parallel or may be configured such that one pump is designated as an operating pump, while one or more additional pumps are designated as standby pumps. Thus, the operating pump normally pumps the fluid, while the standby pump remains in standby in case the operating pump fails or another system condition requires the use of the standby pump. In alternate embodiments, mud pump 68 may include a plurality of pumps configured in series or a single pump. In embodiments, the mud pump 68 may additionally include temperature sensors, flow rate meters, pressure sensors, filters, alarms, or any other suitable components to allow for monitoring and control of the mud pump 68.

The mud pump 68 may comprise one or more variable speed pump, thus allowing variable flow and/or pressure, or may comprise one or more fixed-speed pumps (e.g. with a manifold controlling flow between a plurality of fixed-speed pumps). In embodiments, the mud pump 68 may comprise one or more pumps configured to maintain a consistent flow, such as gallons per minute (gpm or gal/min). In embodiments, the mud pump 68 may comprise one or more particular horsepower (hp) pumps. Multiple flow rates may be identified for any drilling configuration or design, and the mud pump 68 may be configured to provide such flow rates.

While the back-pressure pump 75 is shown as a separate pump in FIG. 1 which is in fluid communication with the mud return line 30 (e.g. in fluid communication between the drilling fluid handling system 52 and the mud return line 30), in some embodiments, the mud pump 68 may include or be configured to serve as the annular backpressure pump (e.g. configured to provide active pressure to annulus 20, for example by pumping fluid into the mud return line 30 between the RCD 22 and the choke manifold 32).

In FIG. 1, fluid flow rate may be measured in one or more locations throughout the system 10, for example between the choke manifold 32 and the drilling fluid handling system 52. In embodiments, fluid flow rate may be measured both going into (e.g. flow-in rate, in the standpipe line 26) and coming out (e.g. flow-out rate, in the mud return line 30) of the wellbore. In embodiments, a discrepancy between the flow rate of the drilling fluid going into the wellbore and the flow rate of the drilling fluid coming out of the wellbore may be indicative of influx.

By way of example, fluid flow rate may be measured by a flow meter (e.g. configured to measure the flow rate of fluid at a location within the system), such as Coriolis meter 58. In some instances, the Coriolis meter may be configured to measure the flow rate of fluid out of the well (e.g. in the mud return line 30), and the fluid flow rate into the well (e.g. through the standpipe line 26) may be measured (e.g. by a flow meter) or calculated (e.g. based on counting pump strokes, for example). Additional measuring may occur in the system in some embodiments, for example measuring the annular pressure (since an unexpected increase in annular pressure can be indicative of influx) at one or more location within the system 10, density of the fluid (e.g. at one or more location in the system 10), drillstring velocity (e.g. relative to the wellbore), choke position (e.g. through which the fluid is currently flowing), mud pit volume (since unexpected gain could be indicative of influx), and/or mud gas (since the gas content of the mud return can help detect influxes).

In embodiments, pressure applied to the annulus 20 can be measured at or near the surface via one or more pressure sensors, which may be in communication with the annulus 20. For example, pressure may be sensed below the RCD 22, but above a blowout preventer (BOP) stack. Pressure may be sensed in the wellhead below the BOP stack. Pressure may be sensed in the mud return line 30, for example upstream of the choke manifold 32. Pressure may be sensed between the choke manifold 32 and the drilling fluid handling system 52.

Another pressure sensor may sense pressure in the standpipe line 26—e.g. standpipe pressure (SPP). Pressure can also be sensed downstream of the choke manifold 32, but upstream of a separator, shaker, and mud pit. Additional sensors can include temperature sensors, one or more Coriolis flowmeter, and/or other flowmeters. For example, flowmeters may be used to detect the fluid flow rate in the mud return line (e.g. flow-out rate) and/or in the standpipe line 26 (e.g. flow-in rate). Sensors may be configured to measure density of the fluid at one or more location within the system 10. Sensors may be configured to detect choke position (e.g. with respect to the choke manifold 32). Sensors may be configured to detect velocity and/or depth of the drillstring 16 (e.g. movement of the drillstring 16 in the wellbore 12).

The various sensors described herein may not all be required, for example with one or more of the sensors being optional. For example, the system 10 could include only one or two flowmeters. However, input from all available sensors can be useful to a hydraulics model (which may be used by the control system 100) and/or to the control system 100 in determining what pressure should be applied to the annulus 20 during the drilling operation.

Other sensor types may be used, if desired. For example, it is not necessary for any particular flowmeter to be a Coriolis flowmeter, and other types of flowmeters, such as a turbine flowmeter, acoustic flowmeter, or another type of flowmeter, could be used instead.

In addition, in embodiments the drill string 16 may include its own sensors, for example, to directly measure downhole pressure. Such sensors may be of the type known to those skilled in the art as pressure while drilling (PWD), measurement while drilling (MWD) and/or logging while drilling (LWD). These drill string sensor systems may provide pressure measurement, and may also provide temperature measurement, detection of drill string characteristics (such as vibration, weight on bit, stick-slip, drillstring velocity, drillstring depth, etc.), formation characteristics (such as resistivity, density, etc.), flow characteristics (such as flow rate of fluid in the drillstring 16 and/or flow rate of fluid in the annulus 20 outside the drillstring 16), and/or other measurements. Various forms of wired or wireless telemetry (acoustic, pressure pulse, electromagnetic, etc.) may be used to transmit the downhole sensor measurements to the surface (e.g. to the control system 100).

Additional sensors could be included in the system 10, if desired. For example, another flowmeter could be used to measure the rate of flow of the fluid 18 exiting the wellhead 24, another Coriolis flowmeter could be interconnected directly upstream or downstream of a rig mud pump 68, etc.

Fewer sensors could be included in the system 10, if desired. For example, the output of the rig mud pump 68 (e.g. the flow rate of fluid into the drillstring (flow-in rate) from the standpipe line 26) could be determined indirectly, for example by counting pump strokes of the mud pump 68 and calculating flow rate therefrom (e.g. based on pump stroke count and pump efficiency), instead of by using a flowmeter for direct measurement.

As shown in FIG. 1, the MPD system 100 may include a control system 100. The control system 100, which is typically a computerized system (for example having one or more processor), may be communicatively coupled to any component of system 10 and configured to control, monitor/measure, maintain, or perform any other suitable function within the system 10. While the control system 100 is shown as being wirelessly coupled in FIG. 1, in other embodiments the control system 100 may have wired connections. Control system 100 may include any instrumentality or aggregation of instrumentalities operable to compute, classify, process, transmit, receive, store, display, record, or utilize any form of information, intelligence, signal, or data. For example, control system 100 may include one or more personal computer, processor, storage device, server, and/or any other suitable device, and may vary in size, shape, performance, functionality, and price. Control system 100 may include random access memory (RAM), one or more processing resources, such as a central processing unit (CPU) or hardware or software control logic, and/or other types of volatile or non-volatile memory. Additional components of control system 100 may include one or more disk drives, one or more network ports for communicating with external devices, one or more input/output (I/O) devices, such as a keyboard, a mouse, or a video display. Control system 100 may be configured to permit communication over any type of network, such as a wireless network, a local area network (LAN), or a wide area network (WAN) such as the Internet. Furthermore, control system 100 may be located in any suitable enclosure, and may be located on the well surface, on a ship, on shore, or in any other suitable location, typically in proximity to the well.

Typically, the system (e.g. control system 100) is configured to try to detect any influx (or loss) and/or to safely circulate a detected influx out of the closed-system, while maintaining well control. For example, the choke manifold 32 and/or backpressure-pump 75 can be used to adjust backpressure (e.g. based on measured values and/or effective modeling and control), to maintain adequate wellbore pressure (e.g. above the pore pressure of the formation, but below fracture pressure). The control system 100 can also estimate the size of the influx (e.g. based on sensed parameters), since knowing the size of the influx can help evaluate the proper techniques to control the influx and the well. If the influx is too large (e.g. beyond the capacity of the MPD system 10), then shut-in may be initiated, but if the influx is sufficiently small, then shut-in may be avoided. In some instances, the influx (which is sufficiently small) can be circulated out of the system 10, for example by dynamically adjusting the backpressure as the influx is circulated out of the system 10. Once the influx has been addressed, drilling can resume, perhaps with modifications to the system 10 based on the influx.

In some embodiments, the system/method (e.g. used by the control system 100) for detecting influx monitors the volume gain between flow-in and flow-out, and the influx event can be confirmed by checking standpipe pressure (e.g. if SPP is increasing) and density (e.g. if density is not decreasing). This approach can work quite well for steady-state conditions. However, this volume gain approach for detecting influx is typically only accurate under certain conditions, limiting its usefulness. For example, in order to use this approach, several preliminary conditions must be checked and met (e.g. confirming steady-state conditions) to allow the detection to be effective. By way of example, flow-in should be steady, the drillstring cannot be moving significantly (e.g. no drillstring movement over a certain speed, such as approximately 10 fpm), and/or there should be no significant choke movement (e.g. less than approximately 3%/s). Even motion caused by ocean movement (e.g. heave in sea-based drilling systems) can cause issues that may tend to lead to inaccuracies in detecting influx. Such scenarios can cause fluctuation of flow-out, and may disqualify the detection process and/or trigger an unacceptable number of false alarms. Additionally, SPP measurement data in such scenarios tends to be noisy (e.g. with the signal noise making it difficult to determine the actual signal levels), making it hard to detect an SPP increase. This is particularly true for small influxes, since for example, the size of the influx may be sufficiently small to be lost in the noise. Also, in transient conditions, such as when a pump turns OFF/ON, and flow-in changes, it can take time for SPP to stabilize sufficiently for an effective reading. Thus, this volume gain approach for monitoring influx typically may not work effectively in transient conditions (for example, it is prone to false alarms because some uncertainties can cause false detections and trigger false alarms in such scenarios), and typically is only configured to be used in steady-state conditions.

Figure 2:
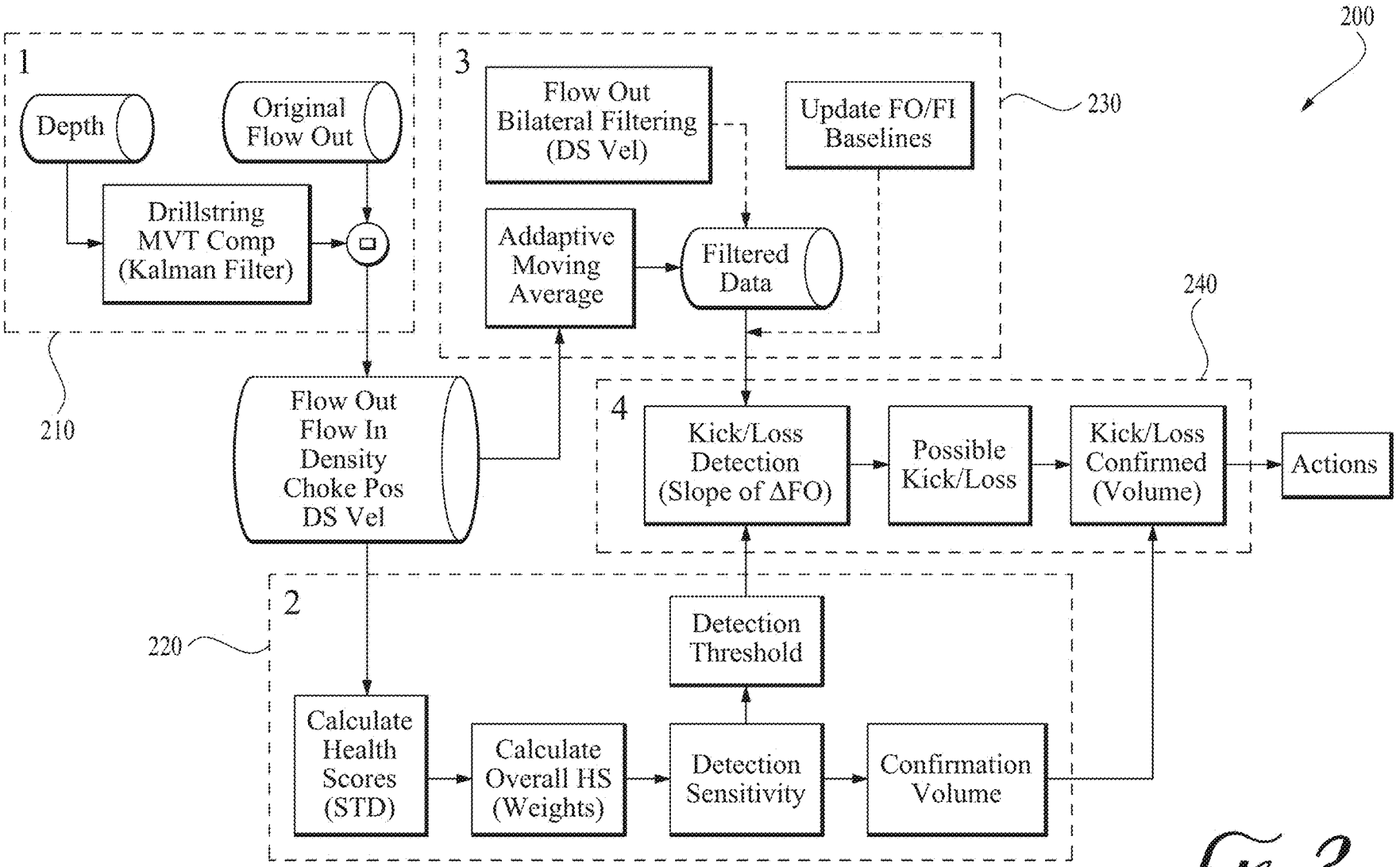
FIG. 2 illustrates schematically an exemplary system for implementing an exemplary method to detect influx (or loss), for example early kick detection in the MPD system of FIG. 1, according to an embodiment of the disclosure.

FIG. 2 illustrates a method (e.g. used by the control system 100) to detect and/or mitigate an influx (or loss)

within an exemplary MPD system, which is configured to address one or more of these concerns, for example providing more effective influx detection (e.g. EKD) configured to operate in both dynamic/transient and steady-state conditions. For example, FIG. 2 illustrates a flow chart of an exemplary method (and associated exemplary system) for detection of an influx (or loss) during drilling operations in accordance with some embodiments of the present disclosure. For illustrative purposes, the method of FIG. 2 may be described with respect to the MPD system 10 of FIG. 1; however, the method may be used for well control when an influx (or loss) is encountered in any appropriate drilling system. It should be understood that discussion herein regarding detection and/or mitigation of an influx may also cover detection and/or mitigation of a loss (which might, for example, be considered a negative influx in some embodiments).

The steps of this exemplary method can be performed by a user, electronic or optical circuits, various computer programs, models, or any combination thereof, configured to process drilling data. For example, the method may be operated by control system 100. The programs and models may include instructions stored on a non-transitory computer-readable medium and operable to perform, when executed, one or more of the steps described below. The computer-readable media can include any system, apparatus, or device configured to store and retrieve programs or instructions such as a hard disk drive, a compact disc, flash memory, or any other suitable device. The programs and models may be configured to direct a processor or other suitable unit to retrieve and execute the instructions from the computer readable media. Collectively, the user, circuits, or computer programs and models used to process the influx detection method may be referred to as a control system 100 and/or operator. For example, the control system 100 may similar to that described with respect to FIG. 1, and may be located at the well site 102. In some embodiments, the control system 100 may be located elsewhere, and may receive information detected and/or stored during the drilling operations and/or send control signals to the MPD system 10 during drilling operations.

As illustrated in FIG. 2, an exemplary method for detecting an influx (or loss), which may for example be part of a well drilling method, can comprise one or more of the following: (1) compensating for drillstring movement (e.g. by subtracting flowrate attributable to drillstring movement from measured fluid flowrate (e.g. out of the well-flow-out rate)), (2) determining a threshold for detection of an influx (or loss) and a detection sensitivity/confirmation volume (for confirming the detected influx) based on quality of the data (e.g. signal/measurement) for various relevant parameters (and typically weights related to various parameter measurements, for example wherein each parameter receives a weight based on its influence on detecting influx), (3) filtering parameter data, such as flow-out and/or flow-in data (e.g. using adaptive data processing such as an adaptive moving average technique, based on data quality, and/or bilateral filtering (e.g. to address choke movement oscillations), (4) detecting a possible influx (or loss)—e.g. by comparing slope of delta flow rate (e.g. difference between flow-out and flow-in) to the threshold to detect possible influx (or loss—e.g. if negative), (5) determining/calculating the size of the possible influx (e.g. a volume, which may for example be determined by subtracting flow-in from flow-out), and confirming the detected influx—e.g. by comparing calculated size of influx to the detection sensitivity, with the influx being confirmed if the size of the influx is greater than the detection sensitivity. In some embodiments, all of these steps may be employed, which may provide synergistic benefits, while in other embodiments, less than all of these steps may be employed. Some method embodiments may further comprise updating and applying baselines to remove any offset (e.g. which may arise when a calculated value is used for flow-in rate, based on pump stroke counting for example).

Some method embodiments may further comprise, responsive to both detection and confirmation of influx (or loss), signaling influx (or loss). For example, the presence and size of the influx may be signaled. Some embodiments may further comprise controlling drilling responsive to signaling, for example in order to control/manage well pressure (BHP). For example, method embodiments may comprise initiating, using one or more controls, corrective actions to control influx/loss. By way of example, corrective actions may include adjusting the choke manifold 32 and/or back-pressure pump 75 or initiating shut-in procedure, for example responsive to and based on the influx determination. While the method shown in FIG. 2 may be used in both steady-state and transient conditions, in some embodiments the method of FIG. 2 might be used in transient conditions, while the more conventional technique (e.g. using volume increase, SPP, and density) may be used alone or in conjunction with the method of FIG. 2 in steady-state conditions.

The exemplary method set forth in FIG. 2 may be thought of as including one or more sub-methods (for example, each providing more detailed method examples for individual steps of the general method of FIG. 2 discussed above), each of which can be used individually or in combination to improve MPD. Illustrative examples of such exemplary (sub) methods are set forth below, although it should be understood that such examples are merely illustrative and are not limiting, and that each of the following can be used alone or in combination (with FIG. 2 illustrating a particular embodiment in which all of the following methods may be jointly used).

In embodiments, a method of compensating for drillstring movement may comprise: providing (e.g. measured) flowrate of drilling fluid in a drilling system (e.g. flow rate of fluid exiting the annulus 20 of the well-flow-out rate), providing (e.g. measured) depth data for the drillstring 16, estimating drillstring 16 velocity (and typically acceleration, which may be calculated based on change of the velocity estimate) based on the depth data of the drillstring 16 (for example using a filter, as discussed in a more detailed example below), calculating flowrate variation caused by drillstring 16 movement based on estimated velocity (and typically acceleration) of the drillstring 16 and the drillstring 16 outer diameter (e.g. compared to the diameter of the wellbore 12), and using the calculated flowrate variation from the drillstring 16 to correct the provided fluid flowrate, thereby determining a corrected flowrate. Instead of estimating the drillstring 16 velocity, in alternate embodiments, the drillstring 16 velocity and/or acceleration may be measured directly and provided for calculation of the flowrate caused by the drillstring 16 movement.

In embodiments, the filter for estimating drillstring 16 velocity may be a Kalman filter, which may be configured to use position/location (e.g. depth of the drillstring 16) data to estimate velocity and/or acceleration of the drillstring 16. In embodiments, measuring flowrate may be performed by a flowmeter (e.g. such as Coriolis meter 58) configured to measure flow rate of fluid out of the well (e.g. flow-out rate in the mud return line 30). In embodiments, using calculated flowrate variation to correct the provided flowrate may comprise subtracting the calculated flowrate variation (caused by drillstring movement) from the provided flowrate. Addressing drillstring movement in this way may allow for more effective influx detection, even in transient conditions (e.g. when drillstring movement exceeds approximately 10 fmp).

In embodiments, a method of determining a threshold for detection of an influx (or loss) and a detection sensitivity/confirmation volume (e.g. allowing for adaptive influx detection) may comprise: providing data (e.g. a signal/measurement) relating to one or more parameter (e.g. using one or more sensors which send a signal to the control system), determining the stability/quality of the data for each parameter, thereby determining a health score (e.g. indicative of likely accuracy/quality) for each parameter based on the stability/quality (which may in some embodiments be scaled so that each parameter health score is set against an equivalent scale range—for example with the health score for each parameter ranging from zero to 100, with higher scores indicative of higher quality and/or more stability), assigning a weight to each parameter (e.g, wherein a parameter receives a weight based on its influence on detecting influx), determining an overall health score based on a weighted sum of the health scores for each parameter (e.g. summing the weighted parameter health scores to determine the overall health score for the influx detection system—e.g. by multiplying each parameter health score by its corresponding weight and then summing the weighted parameter health scores to determine the overall health score), and establishing the threshold to detect influx and the detection sensitivity/confirmation volume (e.g. minimum detectable volume) for confirming influx detection based on the overall health score. The weight assigned to each parameter may be based on its relative importance and/or accuracy (e.g. amount of noise associated therewith) when determining influx. For example, flow-out rate may have a higher weight than density of the fluid. In an example, a weight array may be applied to the parameter health scores when determining overall health score. Scaling the health scores for the various parameters may allow for effective determination of an overall health score using a weighted sum of the health scores.

In embodiments, determining the stability/quality of each parameter may comprise evaluating the stability/quality (e.g. amount of fluctuation/noise/oscillations) of the data for that parameter and assigning a score representative of the quality (e.g. stability). Higher health scores are assigned to parameters in which the data is more stable (e.g. less fluctuation), while lower health scores are assigned to parameters in which the data fluctuates more (e.g. less stability). In embodiments, determining the stability/quality of each parameter may comprise calculating the standard deviation of the data for each parameter in a (e.g. preselected) timeframe (which typically is the same for all parameters) and using the standard deviation to determine stability and/or health score. For example, a larger standard deviation may be indicative of more fluctuations (resulting in a lower health score), while a smaller standard deviation may be indicative of more stability (resulting in a higher health score). In some embodiments, the timeframe for determining the standard deviation may be approximately 2 minutes (e.g. a pre-set time which may range from approximately 1 minute to 3 minutes). In some embodiments, determining the stability of each parameter may comprise using a signal-noise-ratio (e.g. mean/standard deviation). In some embodiments, both standard deviation and signal-noise-ratio approaches may be used to jointly determine the health score for each parameter.

In some embodiments, establishing the threshold to detect influx and the detection sensitivity/confirmation volume may be based on comparison of the overall health score to a look-up table/chart which may be derived from/based upon historical data. For example, the look-up table/chart can be built up using historical data to correlate overall health scores (e.g. calculated based on the conditions present when the historical data was collected) to effective detection thresholds and confirmation volumes for influxes. In embodiments, the look-up table/chart can be regularly updated as new data becomes available, for example based on the detection events within the MPD system and/or data from similar and/or related MPD systems, which may lead to increased accuracy over time. Based on the look-up table/chart, a high overall health score can indicate that a smaller influx can be detected (e.g. finer resolution/granularity), while a lower overall health score can indicate that influx cannot be detected unless it is larger (e.g. not as fine a resolution/granularity). The detection threshold typically may be in units of gpm/s. Similarly, for a higher overall health score, the confirmation volume (e.g. bbl) for the detection sensitivity may be smaller (e.g. finer resolution/granularity), while a lower overall health score may have a confirmation volume that is larger (e.g. less fine resolution/granularity). FIG. 3 illustrates an exemplary lookup table for such a determination (e.g. comparing the calculated overall health score to the table to determine the detection threshold and detection sensitivity/confirmation volume). Such a method may provide an adaptive detection threshold and detection sensitivity, for example setting the detection threshold and confirmation volume based on confidence in the parameter data (e.g. based on the quality of the parameter data). This may help reduce false alarms, since the standards used to detect and confirm influx may change based on the quality/reliability of the data (which should take into account issues arising out of transient conditions, for example).

In embodiments, the one or more parameter may comprise one or more of the following: flow-in rate, flow-out rate, density, choke position, and drillstring velocity. One or more additional parameter, such as pressure and/or density) may be used in other embodiments. In some special processes, the back-pressure pump or a riser flow pump may be used, and their flow rate can be considered as part of the flow-in rate. Some method embodiments may further comprise determining a timeframe/window size based on the health score (e.g. sensitivity) of each parameter, and using the timeframe/window to determine an adaptive moving average for each corresponding parameter (although this aspect may be performed in another sub-method or subsystem in some embodiments, as discussed below). An adaptive moving average may be helpful in limiting the impact of signal noise.

In embodiments, a method of filtering parameter data (e.g. adaptive data processing) may comprise receiving data relating to one or more parameter, such as flow-out rate, and applying one or more filtering technique to the data (e.g. to improve the data, for example for better future analysis). In embodiments, applying one or more filter may result in corrected (e.g. filtered and/or processed) parameter data (e.g. such as corrected flow-out rate). In some embodiments, the data may relate to flow-in rate and/or a health score for each parameter (e.g. indicative of the stability/quality of the signal/measurement for that parameter), in addition to flow-out rate. In some embodiments, the data may relate to one or more of the following: flow-out rate, flow-in rate, density, choke position, drillstring velocity, and health scores for the various other relevant parameters.

In some embodiments, applying one or more filter may comprise using an adaptive moving average technique on the data for each parameter, for example to clean up the signal. While a standard moving average technique (e.g. with a pre-set timeframe for analysis/averaging) could be used instead, an adaptive moving average may provide better results (for example, in transient conditions). For example, if the moving average filter is adapative, the timeframe window for the moving average for each parameter can be based on an indication of the stability/quality of the data for each parameter, such as a health score. In embodiments, using an adaptive moving average technique may comprise determining a size of the time window (e.g. timeframe) to use for the adaptive moving average of each parameter using the health score associated with that parameter, and then filtering the data for that parameter accordingly (e.g. averaging the data for that parameter over the timeframe of the adaptive window). For example, a look-up table/chart may be used to set the timeframe to use when applying the adaptive moving average technique to data for a parameter, based on the overall health score for the parameter at issue. The higher the health score, the smaller the timeframe window can be, while lower health scores may lead to larger timeframes. Based on the selected timeframe, data averaging for each parameter may occur (e.g. resulting in cleaned-up/corrected data values for each parameter, for example with less signal noise). In some embodiments, the time window may range between approximately 1-3 minutes.

In some embodiments, applying one or more filter may comprise applying a filter to address oscillations caused by choke manifold 32 movement. For example, applying one or more filter may comprise applying bilateral filtering to the data (e.g. to address oscillations caused by movement of the choke manifold 32). Bilateral filtering may be able to reduce signal noise arising out of measurement oscillations caused by choke movement, for example, in transient conditions. In some embodiments, bilateral (or other filtering to remove such oscillations) filtering is applied responsive to detected drillstring movement and/or adjustment/movement/positioning of the choke manifold 32. For example, bilateral filtering may be applied when choke manifold movement is more than approximately 3%/s and/or may allow for more effective influx detection even when choke manifold movement exceeds approximately 3%/s. In some embodiments, applying one or more filter may comprise applying a low pass filter to the data for each parameter. In some embodiments, two or more filtering techniques may be applied to the data for each parameter. For example, adaptive moving averaging may first occur, followed by bilateral filtering (although in some embodiments, bilateral filtering may only occur when there is sufficient movement of the drillstring 16 and/or choke manifold 32 causing oscillations).

In some embodiments, a baseline offset may also be addressed. For example, in instances in which the flow-in rate is a calculated value (for example, based on mud pump stroke count) instead of directly measured, there can be a baseline offset between the flow-out rate (e.g. the rate of flow of fluid out of the annulus 20, which may be a measured value) and the flow-in rate (e.g. the rate of flow of fluid into the drillstring 16, for example from the mud pump 69 through the standpipe line 26, which may be a calculated value). In embodiments, the baseline may change due to variation in pump efficiency. An offset baseline may degrade the detection sensitivity and cause inaccurate estimation of influx volume (which could even lead to missing the detection altogether). Accordingly, the baseline of flow-out rate and flow-in rate may be updated, for example using recent and/or filtered flowrate data. Typically, the baselines may only be updated after there has been a change in a parameter (e.g. such that an update may be needed), but thereafter the system has been approximately steady for a period of time (e.g. a window, such as approximately 2 minutes). Updating of the baselines may comprise finding an average value for the parameter for the period of time (e.g. approximately 2 minutes, including the change that initiated consideration). For example, in instances when flow-in rate is changed and then stabilized, and other parameters such as flow-out rate, choke position, drillstring velocity, etc. are stable as well (e.g. substantially unchanged), the baselines of flow-in rate and/or flow-out rate can be updated, for example with the average values of the past period of data (e.g., the average values of past 2 minutes of data, including the change that initiated consideration). The baselines can then be used to remove the offset. For example, the baseline offset can be subtracted out when calculating the flowrate difference (DeltaFR) between flow-out rate and flow-in rate. Consider the following formula in which baseline offset may be addressed: DeltaFR=(Flow-Out-Flow-In)−(baseFO-baseFI).

In embodiments, a method of detecting and confirming influx (or loss) may comprise: receiving flow-in rate and flow-out rate data (e.g. which may be filtered, for example by adaptive data processing and/or may account for drillstring 16 movement), as well as detection threshold and detection sensitivity/confirmation volume data (e.g. which may be adaptive based on data quality), detecting potential influx (or loss), and responsive to detection of a possible influx (or loss), confirming the influx (or loss). In some embodiments, detecting potential influx (or loss) may be based on comparison to the detection threshold. For example, detecting potential influx may comprise calculating the flow rate difference (DeltaFR) between flow-out rate and flow-in rate (for example, which may take into account the baseline offset, if any), calculating the slope of DeltaFR (e.g. where DeltaFR=(Flow-Out−Flow-In)−(baseFO−baseFI)), and comparing the slope to the detection threshold. In the event that the slope of DeltaFR is greater than the detection threshold (or less than a negative detection threshold) when making the comparison, a possible influx (or loss) event can be detected.

In embodiments, confirming the influx (or loss) may comprise, responsive to detection of a possible influx (or loss), calculating the size of the influx (or loss), for example based on the volume gain between flow-in rate and flow-out rate, and comparing the size of the influx (e.g. volume gain) to the detection sensitivity (e.g. confirmation volume). In the event that the size of the influx (e.g. volume gain) is larger than the detection sensitivity/confirmation volume, the influx event can be confirmed. Responsive to confirmation, an event (e.g. influx or loss) may be signaled (e.g. with an alert or an alarm), which may allow action to be taken to address the influx (or loss). In some embodiments, the signal/alert may provide an estimate of the size of the influx (or loss), in addition to merely noting its presence. Embodiments of the disclosed method and related system may be configured to detect influx much more quickly than conventional techniques, for example detecting influx within seconds (e.g. less than 60 seconds, from about 5-60 seconds, from about 5-20 seconds, from about 15-30 seconds, from about 30-50 seconds, from about 20-60 seconds, from about 5-10 seconds, from about 5-15 seconds, less than about 10 seconds, or less than about 5 seconds) rather than taking approximately half an hour (as may occur using conventional techniques).

Some embodiments may further comprise (e.g. after detection and confirmation and/or as part of signaling) suggesting possible actions or automatically taking one or more action, for example controlling one or more element of the MPD system 10, to address the event. Responsive to detection and confirmation of an event (e.g. influx or loss), actions may be taken in the MPD drilling system 10 to address the issue. So, some embodiments may further comprise controlling drilling responsive to the signaling/alerting, for example in order to control/manage well pressure (BHP). This may include initiating, for example using one or more controls, corrective actions to control influx or loss. For example, the choke manifold 32 and/or back-pressure pump 75 may be used to adjust the backpressure (e.g. which may modify the well pressure, e.g. in the annulus 20), the rate of the mud pump 68 may be altered to adjust flow-in rate, the influx may be circulated out of the system 10, and/or shut-in procedures may be initiated (e.g. if the influx is too large to otherwise be controlled and/or circulated out).

Disclosed embodiments also include an exemplary system 200 (e.g. with associated exemplary subsystems) which may be configured to implement influx or loss event detection methods, such as described with respect to FIG. 2. For example the system 200 shown in FIG. 2 may be implemented by the control system 100, which may receive sensor data from the drilling system 10, use the sensor data to detect events (e.g. using a method similar to that described with respect to FIG. 2), and in some instances alert/signal regarding the detected event or automatically take action responsive to detection of an event.

For example, the step(s) relating to compensating for drillstring movement can be performed by subsystem 210 (e.g. relating to drillstring movement compensation). Subsystem 210 can be configured to receive depth data (e.g. data relating to the depth/position of the drillstring in the wellbore) and flow-out rate data (e.g. the rate of fluid flow out of the annulus 20 measured by a flow meter, such as a Coriolis meter), and to use the depth data in a Kalman filter to update the flow-out rate data based on a flow rate caused by drillstring movement. For example, the flow rate caused by the drillstring 16 can be calculated based on the drillstring velocity and/or acceleration (for example, along with the diameter of the drillstring 16 and/or the diameter of the wellbore 12). The calculated/estimated flowrate caused by the drillstring 16 can then be subtracted from the flow-out rate data, to provide an updated flow-out rate. By accounting for drillstring movement, more accurate influx detection can be possible in such transient state conditions.

In embodiments, the step(s) relating to determining a threshold for detection of an influx (or loss) and a detection sensitivity/confirmation volume for confirming the influx can be performed by subsystem 220 (e.g. relating to adaptive detection sensitivity). For example, subsystem 220 can be configured to receive data relating to a number of parameters, such as flow-out rate, flow-in rate, density, choke position, and drillstring velocity data. Subsystem 220 can then calculate a health score for each parameter (e.g. based on the stability of the data for each parameter, wherein the health score is generally indicative of the quality of the data, e.g. signal or measurement, for that parameter, which may be scaled). For example, subsystem 220 may evaluate the quality/stability of the data for each parameter using standard deviation calculations, and typically then scaling so that the health score for each parameter has the same scale range. Subsystem 220 can also be configured to weight the health score of the parameters (for example, based on which parameters are most significant to detecting influx) and to cumulate the weighted health scores of the parameters to determine an overall health score.

Subsystem 220 can then use the overall health score to determine the detection threshold and detection sensitivity/confirmation volume. For example, subsystem 220 can compare the overall health score to a chart or table (e.g. based on historical data) to determine the detection threshold and the confirmation volume based on the quality/stability of the data. In this way, subsystem 220 can adaptively determine the detection threshold and the detection sensitivity (e.g. confirmation volume) based on the stability/quality of the data, rather than simply using static, pre-set values. With such an adaptive technique, the better (e.g. as indicated by a higher overall health score) the stability/quality of the data, the smaller sensed changes in the system 10 can be used to detect and confirm influx or loss (e.g. improved sensitivity of the detection system, enabling smaller influxes to be detected); the worse (e.g. as indicated by a lower overall health score) the stability/quality of the data, the larger sensed changes in the system 10 need to be to be considered indicative of an influx or loss (e.g. the detection system is not as sensitive, and can only pick up larger influxes). Using an adaptive threshold may, for example, reduce false alarms in the system. Using such an adaptive determination can address some concerns arising during transient state conditions.

In embodiments, the step(s) related to filtering one or more data/measurement signal (e.g. adaptive data processing) can be performed by subsystem 230 (e.g. relating to filtering of the data/adaptive data processing). Subsystem 230 can be configured to receive data relating to various parameters, such as flow-out rate and a health score for each parameter (indicative of the quality of the data for that parameter, for example as generated in subsystem 220). In some embodiments, subsystem 230 can also receive data relating to flow-in rate, etc. In some embodiments, the flow-out rate data may already account for movement of the drillstring 16 (for example, as discussed with regard to subsystem 210). In embodiments, subsystem 230 can be configured to use the health score for each parameter to determine the size/duration of the time window to use for determining an adaptive moving average of each corresponding parameter, and to filter the data for that parameter accordingly (e.g. averaging the data for that parameter over the timeframe of the adaptive window of time). In embodiments, subsystem 230 can be configured to apply filtering to address oscillations caused by choke manifold movement, such as bilateral filtering, to the data (e.g. to address oscillations caused by movement of the choke manifold). For example, subsystem 230 may apply bilateral filtering in instances when there is sufficient choke movement in the system (e.g. more than approximately 3%/s). In embodiments, in instances when the flow-in rate is calculated, for example based on pump 68 stroke count, subsystem 230 can be configured to update the baselines, for example for flow-in rate and flow-out rate (e.g. using the filtered parameter data), and to use the (updated) baselines to remove any offset between measured flow-out rate and calculated flow-in rate (e.g. which might arise due to inaccuracies relating to pump efficiency). In embodiments, baselines may be updated regularly, or updates may be event-based (e.g. after the pump starts and flow rate stabilizes).

In embodiments, the step(s) relating to detecting and confirming influx (or loss) can be performed by subsystem 240 (e.g. relating to event detection and confirmation). For example, subsystem 240 can be configured to receive flow-in rate and flow-out rate data (e.g. which may be filtered, for example by adaptive data processing as in subsystem 230), as well as detection threshold and detection sensitivity/confirmation volume data (e.g. from adaptive detection sensitivity subsystem 220). Subsystem 240 can be configured to then detect potential influx (or loss), for example by comparison to the detection threshold (e.g. from subsystem 220). For example, subsystem 240 may calculate the flow rate difference (DeltaFR) between flow-out rate and flow-in rate (for example, taking into account the baseline offset, if any), calculate the slope of DeltaFR, and compare the slope to the detection threshold (e.g. from subsystem 220). In the event that the slope of DeltaFR is greater than the detection threshold (or less than a negative detection threshold), a possible influx (or loss) event can be detected by subsystem 240.

Responsive to detection of a possible influx (or loss), subsystem 240 can be configured to then confirm the influx (or loss). For example, subsystem 240 can calculate the size of the influx (or loss), which may for example be the volume gain between flow-in rate and flow-out rate, and compare the size of the influx (e.g. volume gain) to the detection sensitivity (e.g. confirmation volume), for example from subsystem 220. In the event that the size of influx (e.g. volume gain) is larger than the detection sensitivity/confirmation volume, the influx event can be confirmed. Responsive to confirmation, subsystem 240 can be configured to signal an event (and in some instances, to suggest possible actions or to automatically take one or more action, for example controlling one or more element of the system 10 to address the event).

While FIG. 2 illustrates a number of the subsystems/processes being used together to improve the MPD system, in some embodiments only one or more of the subsystems may be used as part of the MPD system (with each subsystem providing benefit over a standard system, for example to improve operation of the system 10 in transient, non-steady-state conditions). For example, subsystem 210 (relating to drillstring movement compensation) can be used alone or in conjunction with one or more other subsystem, subsystem 220 (relating to adaptive detection sensitivity) can be used alone or in conjunction with one or more other subsystem, subsystem 230 (relating to filtering of the data/adaptive data processing) can be used alone or in conjunction with one or more other subsystem (for example, in conjunction with the adaptive detection sensitivity subsystem 220 and/or the drillstring movement compensation subsystem 210), and the event detection and confirmation subsystem 240 can be used alone or in conjunction with one or more other subsystem (for example, in conjunction with the adaptive detection sensitivity subsystem 220 and/or the adaptive data processing subsystem 230). Furthermore, specific aspects of any subsystem may be used alone or in conjunction with other aspects of the relevant subsystem. For example, bilateral filtering can be used alone or in conjunction with adaptive moving average filtering and/or one or more filtering can be used alone or in conjunction with updating of baselines, for instance in subsystem 230 (relating to filtering of data/adaptive data processing). Additionally, aspects described with respect to one subsystem can be located instead in another subsystem or in an independent subsystem. Each subsystem can provide benefit to the MPD system, and jointly can provide significant benefit to detecting and addressing influx issues and managing pressure in the well, particularly providing improvement detecting influx in transient state (e.g. non-steady-state) conditions. The system of FIG. 2 (and/or each subsystem) can be implemented by the control system 100 or similar computerized system and/or may relate to and/or interact with the MPD system 10.

If an influx (or loss) is detected, one or more actions may be taken in response to the detection. For example, an alarm or other notification to rig personnel may be activated. In some instances, the alarm or notification may communicate whether mitigation may occur or whether shut-in procedures should be employed (for example, depending on the size of the influx detected). In some instances, options for action may be provided to an operator. In some instances, back-pressure may be adjusted (e.g. increased) to address a detected influx (e.g. using the choke manifold 32 and/or the back-pressure pump 75). Personnel/operators at the rig/well may take actions as necessary or advisable based on the influx detection information provided by the control system 100 regarding the MPD system 10. In some embodiments, corrective actions/adjustments may be automatically employed, for example with the control system automatically controlling one or more elements of the MPD system 10. In some embodiments, a machine learning model can be used, for example to continually update and refine the detection model/system and/or to automatically signal/alarm influx (or loss) and/or automatically take corrective action. For example, the model could be updated based on ongoing data collected from the drilling process. By way of example, the look-up table/chart (or a formula derived from such) correlating the overall health score to the detection threshold and confirmation volume could be updated as new data is observed.

The early kick detection (EKD) techniques discussed above (e.g. with respect to FIG. 2) are one way to manage fluid in a managed pressure drilling system, but there are alternate approaches that can be used instead of or in conjunction with early kick detection. For example, in some embodiments, the trip tank volume changes (e.g. of the drilling fluid handling system 52) may be monitored.

Drilling oil wells can be a complex and risky activity, requiring a high degree of precision and control. Different tools, such as mass flow meters, can be used to measure fluid flow in/out during drilling. Such sensors can be especially useful in drilling operations, as they may allow the control of drilling mud flow and may detect possible fluid losses or influxes in the well.

In embodiments, a trip tank can serve as a compact, independent reservoir on a drilling rig. For example, its primary function may be to oversee and regulate the quantity of drilling fluid (e.g. mud) being pumped into or withdrawn from the well bore, particularly during specific procedures like making connections or tripping pipe. The trip tank may play an important role in identifying abrupt alterations in the wellbore fluid level, and thus may serve as an early warning system for potential kicks (e.g. influx of formation fluids) or losses (e.g. fluids escaping into the formation). Vigilant monitoring of the trip tank volume can be used to help maintain well control and preventing drilling incidents.

Unfortunately, trip tank monitoring may inherently involve delays in monitoring (e.g. a lag effect) and/or may not be as accurate as desired (for example, with the lag effect of various measurements and/or measurement inaccuracies caused by transient conditions acting to reduce accuracy for real-time monitoring). For example, the large size of the trip tank and/or the viscosity of the fluid within the trip tank can make accurate and/or real-time updates difficult. To provide similar benefits to monitoring of an actual a trip tank while addressing one or more of such issues and/or offering improved functionality, a virtual trip tank may be used (e.g. instead or in conjunction with the actual trip tank monitoring) in some Managed Pressure Drilling systems.

When drilling with Managed Pressure Drilling (MPD) equipment, the Virtual Trip Tank (VTT) can be created (e.g. using the control system 100), for example through programming. The VTT may be configured to measure the flow of drilling mud in the well, identifying potential fluid losses or gains by comparing input data from mud pump flow meters with output data from flow meters (typically Coriolis meters on MPD surface equipment) during fluid return. A trend towards loss can suggest induced well fractures during drilling, while a gain trend can be indicative of gas or hydrocarbon contribution, requiring immediate adjustments to the pressure profile based on control matrices. The VTT's advantage may lie in the early and/or accurate detection of possible well issues. Detected losses can be promptly corrected to prevent severe consequences, and gains can be managed to avoid Non-Productive Time (NPT) due to well closure or control. The VTT trend is normally used with other EKD algorithms as an approach for event confirmation. By way of example, EKD (e.g. similar to FIG. 2) may first identify a potential problem, and VTT can then be used for event confirmation. For conventional drilling equipped with a Coriolis meter at the return flow line, the VTT can also be implemented.

The VTT's reliability may hinge on high-quality mass flow sensors and accurate data, with skilled personnel needed for informed data interpretation. Although the VTT values may be taken as trends rather than point values, they can prove helpful in supporting algorithms for "early kick detection" (EKD) in the oil industry. As discussed above, EKD can be important for the early identification of unwanted fluid entry into the well, especially in drilling oil wells where the presence of gas, water, or hydrocarbons in undesirable zones can pose drilling, safety, and environmental challenges. In essence, the Virtual Trip Tank is another useful tool in drilling oil wells, enabling early issue detection and generating trends for early kick detection, which may be contingent on sensor quality, data accuracy, and the expertise of interpreting personnel.

Because the effectiveness of Virtual Trip Tank (VTT) depends on the quality of mass flow sensors and/or the accuracy of the data obtained, the reliability of VTT's measurements and/or interpretations drawn therefrom can be compromised if these sensors are not of sufficiently high quality and/or if there are inaccuracies in the data. Regular maintenance and calibration of equipment can also be essential to enhance the overall reliability and performance of the Virtual Trip Tank.

In some embodiments, VTT can be calculated as follows:

$$VTT = \sum (FlowOut\ \text{Rate} - FlowIn\ \text{Rate}) \times \Delta t\ (\text{bbl})$$

The use of a Coriolis meter in the system can enable the accurate measurement of the return flow rate (FlowOut Rate). However, some uncertainties can cause inaccurate measurement of the FlowIn Rate, instability and/or fluctuation of the FlowOut Rate, and/or lead to inaccurate VTT calculation. For example:

- Flow In Rate (e.g. pump flow rate) may be obtained, in some embodiments, by multiplying pump stroke count with pre-calibrated pump efficiency, instead of direct measurement (although in other embodiments, a sensor may directly measure FlowIn Rate). Pump efficiency may change during operation. Typically, there can be a baseline offset between flow rate out and flow rate in, and the baseline may change due to the variation of pump efficiency. An offset baseline may act to degrade the accuracy of VTT calculation.
- In some transient scenarios, such as pump ON/OFF, a phase delay between flow rate out and flow rate in may affect the accuracy of the VTT calculation.
- When the influx bottoms up, the presence of gas in the fluid can affect the Coriolis meter's reading and accuracy, which may affect the accuracy of the VTT calculation.
- During tripping (e.g. running the drillstring downhole), the FlowOut Rate can fluctuate because of the acceleration and deacceleration of the drillstring. Meanwhile, the BHP may change because of the drillstring movement. To maintain the constant BHP, the surface backpressure can be adjusted for compensation by changing the choke position. The variation of choke position can fluctuate the FlowOut Rate more and influence the VTT calculation and stability.
- Surge and swab (e.g. due to movement of the drillstring) can cause fluctuation of BHP and FlowOut Rate. Change of choke position for SBP compensation can make the flow out fluctuate more, affecting the VTT calculation and stability.
- For deep water operations on drilling ships, heave can cause flow-out fluctuation and/or require choke movement for BHP compensation, which can affect the VTT calculation and stability.

Because of noise and fluctuation disturbances of the sort described above, there may be a need for an improved VTT system. In order to address one or more of these concerns/issues (e.g. to improve VTT accuracy and reliability not only for steady-state conditions, but also for transient scenarios), the data for the VTT calculation may be filtered and/or otherwise corrected, which may lead to improved accuracy and/or reliability in detecting gains and/or losses in the system (e.g. using VTT). For example, embodiments may use one or more of the same subsystems/modules and/or process steps for filtering/correcting data as discussed with respect to the EKD of FIG. 2, but as part of a virtual trip tank calculation and analysis.

By way of example, one or more of the following approaches/techniques may be employed:

- Embodiments may estimate drillstring velocity (DS Vel) and/or acceleration (DS Acc) from depth data using the Kalman filter, and then calculate flow rate fluctuation caused by the drillstring movement with DS Vel, DS Acc, and/or drillstring OD (cross-section area), and remove the influence by subtracting it from the original flow-out. In some embodiments, time-shifting may be performed before subtraction.
- Embodiments may evaluate the quality/stability of signals (e.g. Flow Out, Flow In, Density, Choke Position, and/or DS Vel), for example using standard deviation and/or signal-noise ratio or other techniques, and based on the signal quality/stability, determine an adaptive size of a moving window and apply the adaptive moving average to the signals involved with the VTT calculation (Flow In Rate, FlowOut Rate, etc.) for denoising.
- When the drillstring moves over a certain speed because of surge/swab, heave, tripping, etc., the choke position can be controlled to compensate for the BHP variation to maintain a constant BHP. This can cause the flow out to oscillate. Embodiments may treat the oscillation caused by the choke movement as noise, for example using a bilateral filter and/or a moving average/low pass filter to remove the oscillation and get the trend line of FlowOut Rate. This can help remove the fluctuation in FlowOut Rate and can improve the accuracy and reliability of VTT calculation.

Embodiments may then calculate the VTT based on filtered/corrected signals/data (e.g. FlowRate In, FlowRate Out, etc.).

Similar to the discussion above (e.g. regarding module 210), drillstring velocity and acceleration can be estimated through the Kalman filter from depth data. Flow rate variation caused by drillstring movement can be calculated using the velocity and acceleration of the drillstring and drillstring outer diameter. Subtracting the flow rate caused by drillstring movement from flow-out measurement (e.g. Flow-Out Rate) can decrease the flow-out fluctuation. In embodiments, the depth data may be provided by a rig DAQ system, and the Flow-Out Rate can be measured by the MPD DAQ system. In some embodiments, there may be a phase delay/shifting when compensating the flow rate with Kalman filter estimation based on the depth data, and the time/phase delay caused by communication and filtering can be estimated (e.g. during fingerprinting testing of the system, for example as discussed in more detail below) to allow the estimated flow-out to be shifted correspondingly (which may allow for better results to be achieved).

The quality/stability of signals (e.g. Flow Out, Flow In, Density, Choke Position, and/or DS Vel) can be evaluated based on standard deviation and/or signal-noise-ratio or other techniques (e.g. similar to the discussion above regarding a portion of module 220). The result of such evaluation can be used to determine the adaptive size of a moving window (e.g. similar to the discussion above with respect to module 230), with the adaptive moving average during that window of time applied to the signals involved with the VTT calculation (FlowIn Rate, FlowOut Rate, etc.) for denoising.

As discussed above, alteration of the choke position (e.g. to compensate for the BHP fluctuation caused by drillstring movement (tripping, surge/swab, heave, etc.)) can introduce inaccuracies in measurements, which may impact the VTT calculation. A Bilateral filter can be used to remove the flow-out oscillation caused by such choke movement (e.g. similar to the discussion above regarding module 230).

Baselines of flow rate in and flow rate out can be updated regularly or in an event-based manner (e.g., after the pump starts and flow rate stabilizes), similar to the discussion above with regard to module 230. In some embodiments, subtracting (e.g. updated) baselines from flow rate when calculating flow rate differential can improve VTT accuracy. For example, the baseline of flow-out (baseFO) and flow-in (baseFI) may be updated with filtered flow rate data, after detecting the pump being turned ON and the flow stabilized. The baselines can be used to remove the offset between measured flow-out and calculated flow-in because of inaccurate pump efficiency (for example if Flow-In Rate is calculated rather than measured). For example, the flow rate difference (DeltaFR) between compensated and filtered flow-out (Flow-Out Rate) and flow-in (Flow-In Rate) may be calculated considering the baseline offset, as shown below.

$$DeltaFR = (FlowOut - FlowIn) - (baseFO - baseFI)$$

Once any filtering/correcting has taken place, the VTT can then be calculated more accurately using the filtered/corrected data (e.g. Flow-Out Rate and/or Flow-In Rate). For example, VTT may be calculated by integrating DeltaFR with time: $VTT=\Sigma DeltaFR\times\Delta t$ (bbl).

Figure 4:
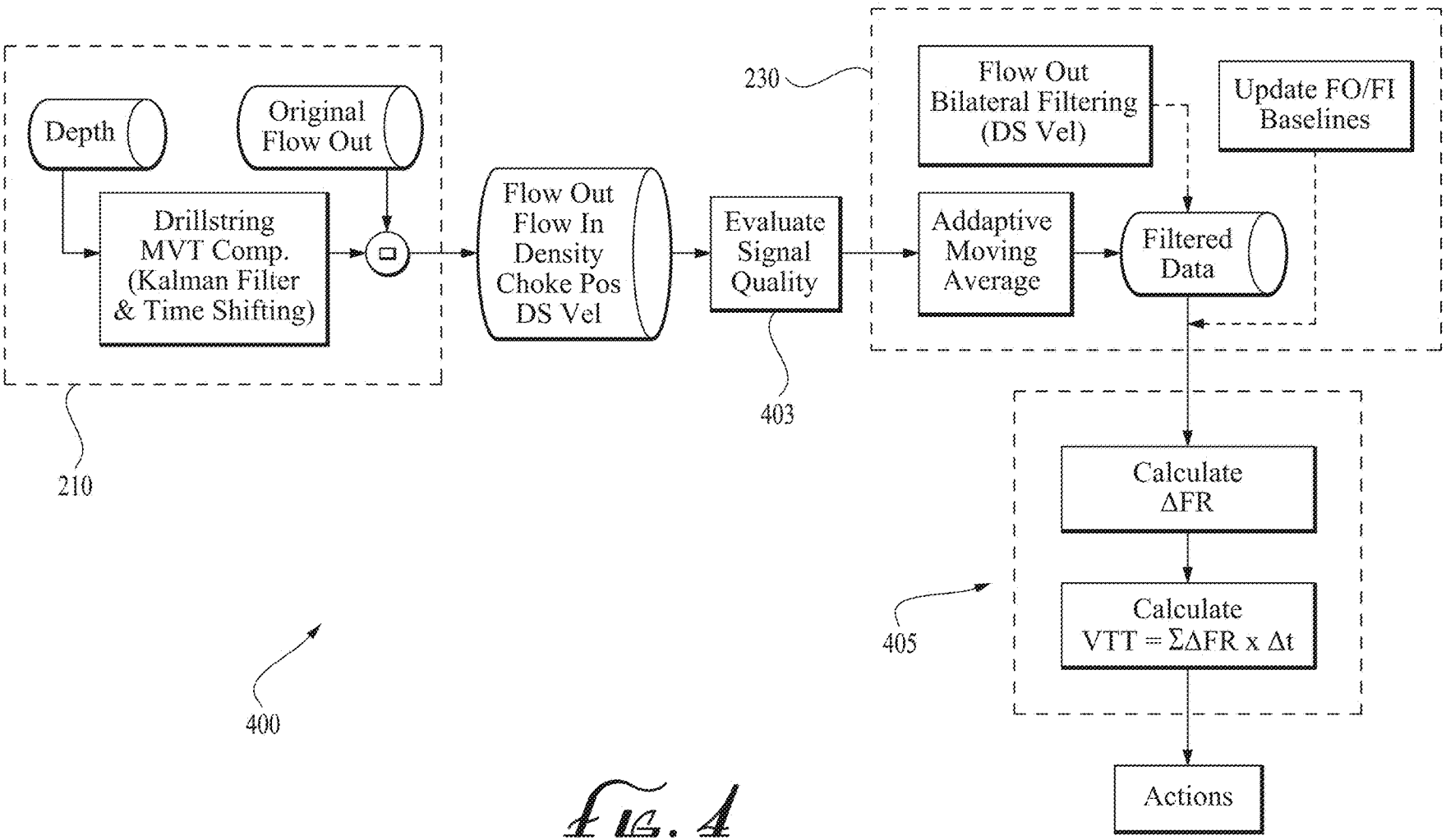
FIG. 4 illustrates schematically another exemplary system for implementing an exemplary method to detect fluid gains or losses in a system, for example in the MPD system of FIG. 1, according to an embodiment of the disclosure.

FIG. 4 illustrates an exemplary method (e.g. for identifying/detecting/estimating potential fluid losses or gains in a managed pressure drilling system (e.g. for use drilling a well)), comprising: providing data (e.g. a signal/measurement) relating to one or more parameter of the drilling system (e.g. using one or more sensors which send a signal to the control system); filtering/correcting parameter data (e.g. such as flow-out rate and/or flow-in rate data), for example by applying one or more filtering/correcting technique to the data; using the filtered/corrected data to calculate the flowrate difference (DeltaFR) between flow-out rate and flow-in rate; and detecting/estimating possible fluid losses or gains in the system by calculating a virtual trip tank (VTT) using DeltaFR. For example, VTT may be determined based on $VTT=\Sigma(DeltaFR)\times\Delta t$).

Typically, the data relating to one or more parameter may comprise: flow-out rate, flow-in rate, density, choke position, and/or drillstring velocity. For the VTT calculation, flow-out rate and/or flow-in rate may be filtered/corrected. In embodiments, filtering/correcting parameter data can comprise applying one or more filtering technique to such parameter data. For example, one or more of the following may be used: an adaptive moving average technique (for example to clean up the signal by removing noise); a bilateral filtering technique (e.g. to address oscillations caused by movement of a choke/choke manifold of the drilling system); addressing (e.g. subtracting out) a baseline offset (e.g. which may be updated based on filtered/corrected data); and/or compensating for drillstring movement (e.g. by subtracting out flowrate attributable to drillstring movement from measured fluid flowrate). FIG. 4 illustrates an embodiment in which all of these techniques may be used to filter/correct the data, in order to improve the VTT calculation. The filtered/corrected data can be used to calculate DeltaFR, which can then be used to calculate the Virtual Trip Tank (VTT). In FIG. 4, the VTT calculation comprises the following: $VTT=\Sigma(DeltaFR)\times\Delta t$). The VTT calculation can be used to guide or direct action in the system, for example corrective action if the gains or losses are sufficiently large (e.g. in excess of/beyond a pre-set threshold).

FIG. 4 also illustrates an exemplary system 400 for implementing such a method. In FIG. 4 the data may be filtered/corrected using module 210 (e.g. for addressing drillstring movement), 403 (e.g. for evaluating signal quality, similar to the discussion above with respect to module 220), 230 (e.g. for applying adaptive moving averaging, bilateral filtering, and/or baseline offset), and 405 (e.g. for using the filtered/corrected data to calculate VTT). For example, module 210 may address drillstring movement. The signal quality for the data may be evaluated (e.g. in module 403, which may be similar to the signal evaluation portions of module 220 discussed with respect to FIG. 2) in order to set a time window size for adaptive moving average filtering (e.g. in module 230). Also in module 230, bilateral filtering may occur and updated baselines may be applied. Module 405 may use this filtered/corrected data to calculate DeltaFR, which is then used to determine/estimate VTT. Actions may be taken in the drilling system based on the VTT result.

It should be understood that, while FIG. 4 illustrates an embodiment in which all data filtering/correcting modules and/or steps from FIG. 2 may be used (e.g. subsystems/ modules 210, 403, 230, and 405), in other embodiments less than all of the modules may be employed (e.g. one or more, but not necessarily all, of the modules/steps may be used to process data). In some embodiments, the system 400 and/or method of FIG. 4 may be used alone, but in other embodiments it may be used in conjunction with the system 200 and/or method of FIG. 2. For example, VTT (see for example FIG. 4) can be used to confirm/verify the results of influx detection (e.g. Early Kick Detection-see FIG. 2). In some embodiments, VTT can be performed in response to detection of influx (e.g. EKD using FIG. 2). These and other embodiments will be better understood with reference to the figures and the additional disclosure below, all of which are included within the scope of disclosure herein.

ADDITIONAL DISCLOSURE

The following are non-limiting, specific embodiments in accordance with the present disclosure:

In a first embodiment, a method for detecting an influx (or loss) in a drilling system comprises: determining a threshold for detection of an influx (or loss) and a detection sensitivity (e.g. confirmation volume) based on stability/quality of the data for one or more parameter of the drilling system (and typically weights related to various parameter measurements, for example wherein each parameter receives a weight based on its influence on detecting influx), detecting a possible influx (or loss) using the detection threshold, determining/calculating the size of the possible influx, and confirming the detected influx using the detection sensitivity.

A second embodiment can include the method of the first embodiment, wherein determining a threshold for detection of an influx (or loss) and a detection sensitivity further comprises: providing data (e.g. a signal/measurement) relating to one or more parameter (e.g. using one or more sensors which send a signal to the control system); determining the stability/quality of the data for each parameter, thereby determining a health score (e.g. indicative of likely quality/stability) for each parameter based on the corresponding stability/quality (which may in some embodiments be scaled so that each parameter health score is set against an equivalent range—for example with the health score for each parameter ranging from zero to 100, with higher scores indicative of more sensitivity), assigning a weight to each parameter (e.g, wherein a parameter receives a weight based on its influence on detecting influx), determining an overall health score based on a weighted sum of the health scores for each parameter (e.g. summing the weighted parameter health scores to determine the overall health score for the influx detection system—e.g. by multiplying each parameter health score by its corresponding weight and then summing the weighted parameter health scores to determine the overall health score), and establishing the threshold to detect influx and the detection sensitivity/confirmation volume (e.g. minimum detectable volume) for confirming influx detection based on the overall health score.

A third embodiment can include the method of the second embodiment, wherein determining the stability/quality of each parameter comprises evaluating the quality (e.g. amount of stability/fluctuation/noise/oscillation) of the data for that parameter and assigning a score representative of the stability/quality.

A fourth embodiment can include the method of the second or third embodiment, wherein determining the stability/quality of each parameter may comprise calculating the standard deviation of the data for each parameter in a (e.g. pre-selected) timeframe (e.g. approximately 2 minutes) and using the standard deviation to determine stability/quality.

A fifth embodiment can include the method of any one of the second to fourth embodiments, wherein determining the stability/quality of each parameter may comprise using a signal-noise-ratio.

A sixth embodiment can include the method of any one of the second to fifth embodiments, wherein determining a threshold to detect influx and detection sensitivity/confirmation volume may be based on comparison of the overall health score to a look-up table/chart derived from/based upon historical data.

A seventh embodiment can include the method of any one of the first to fifth embodiments, wherein the one or more parameter may comprise one or more of the following: flow-in rate, flow-out rate, density, choke position, and drillstring velocity (e.g. one or more of which may be monitored by one or more sensor).

An eighth embodiment can include the method of any one of the second to seventh embodiments, further comprising determining a timeframe/window size based on the health score (e.g. stability/quality) of each parameter, and using the timeframe/window to determine an adaptive moving average for each corresponding parameter.

A ninth embodiment can include the method of any one of the first to eighth embodiments, further comprising compensating for drillstring movement (e.g. impact of drillstring movement on flowrate).

A tenth embodiment can include the method of the ninth embodiment, wherein compensating for drillstring movement comprises subtracting flowrate attributable to drillstring movement from measured fluid flowrate (e.g. out of the well-flow-out rate).

An eleventh embodiment can include the method of the ninth of tenth embodiment, wherein compensating for drillstring movement may comprise: providing (e.g. measured) flowrate of drilling fluid in a drilling system (e.g. flow rate of fluid exiting the annulus of the well-flow-out rate), providing (e.g. measured) depth data for the drillstring, estimating drillstring velocity (and in some instances acceleration) based on the depth data of the drillstring using a filter, calculating flowrate variation caused by drillstring movement based on estimated velocity (and in some instances acceleration) of the drillstring and the drillstring outer diameter (e.g. compared to the diameter of the wellbore), and using the calculated flowrate variation from the drillstring to correct the provided flowrate, thereby determining a corrected flowrate.

A twelfth embodiment can include the method of the eleventh embodiment, wherein the filter for estimating drillstring velocity is a Kalman filter, which may be configured to use position/location (e.g. depth of the drillstring) data to estimate velocity and/or acceleration of the drillstring.

A thirteenth embodiment can include the method of the ninth or tenth embodiment, wherein compensating for drillstring movement may comprise: providing (e.g. measured) flowrate of drilling fluid in a drilling system (e.g. flow rate of fluid exiting the annulus of the well-flow-out rate), providing (e.g. measured) drillstring velocity (and in some instances acceleration), calculating flowrate variation caused by drillstring movement based on velocity (and in some instances acceleration) of the drillstring and the drillstring outer diameter (e.g. compared to the diameter of the wellbore), and using the calculated flowrate variation from the drillstring to correct the provided flowrate, thereby determining a corrected flowrate.

A fourteenth embodiment can include the method of any one of the tenth to thirteenth embodiments, further comprising measuring fluid flowrate, wherein measuring fluid flowrate may be performed by a flowmeter (e.g. a Coriolis meter) configured to measure flow rate of fluid out of the well (e.g. in the mud return line of the drilling system).

A fifteenth embodiment can include the method of any one of the eleventh to thirteenth embodiments, wherein using calculated flowrate variation to correct provided flowrate may comprise subtracting the calculated flowrate variation (e.g. caused by drillstring movement) from the provided (e.g. measured) flowrate.

A sixteenth embodiment can include the method of any one of the first to fifteenth embodiments, further comprising filtering parameter data, wherein filtering parameter data comprises filtering parameter data to remove oscillations caused by movement of the choke manifold.

A seventeenth embodiment can include the method of the sixteenth embodiment, wherein filtering parameter data to remove oscillations may only occur if choke manifold movement is greater than approximately 3%/s.

An eighteenth embodiment can include the method of any one of the first to seventeenth embodiments, further comprising filtering parameter data (e.g. such as flow-out rate and/or flow-in rate data).

A nineteenth embodiment can include the method of the eighteenth embodiment, wherein filtering parameter data further comprises receiving data relating to one or more parameter (e.g. such as flow-out rate), and applying one or more filtering technique to the data (e.g. to improve the data, for example for better influx detection analysis).

A twentieth embodiment can include the method of the nineteenth embodiment, wherein applying one or more filter may result in corrected parameter data (e.g. such as corrected flow-out rate).

A twenty-first embodiment can include the method of the nineteenth or twentieth embodiment, wherein receiving data relating to one or more parameter comprises receiving flow-in rate and/or a health score (e.g. the overall health score) for each parameter (e.g. indicative of the quality of the data for that parameter), in addition to flow-out rate.

A twenty-second embodiment can include the method of the nineteenth or twentieth embodiment, wherein receiving data relating to one or more parameter comprises receiving one or more of the following: flow-out rate, flow-in rate, density, choke position, drillstring velocity, and overall health scores for the various other relevant parameters.

A twenty-third embodiment can include the method of any one of the nineteenth to twenty-second embodiments, wherein applying one or more filtering technique may comprise using an adaptive moving average technique on the data for each parameter (for example to clean up the signal by removing noise).

A twenty-fourth embodiment can include the method of the twenty-third embodiment, wherein using an adaptive moving average technique may comprise determining a time window (e.g. timeframe) size to use for the adaptive moving average of each parameter based on the health score (e.g. stability/quality) associated with that parameter, and then filtering the data for the corresponding parameter accordingly (e.g. averaging the data for that parameter over the timeframe of the adaptive window).

A twenty-fifth embodiment can include the method of the twenty-fourth embodiment, wherein determining a time window size may comprise using a look-up table/chart (e.g. based on or having historical data) to set the size of the time window to use when applying the adaptive moving average technique to data for a parameter, based on the health score for the parameter at issue.

A twenty-sixth embodiment can include the method of the twenty-fifth embodiment, wherein higher health scores lead to smaller timeframe windows, while lower health scores lead to larger timeframe windows (e.g. with timeframe windows ranging from about 1 minute to about 3 minutes, depending on the health score).

A twenty-seventh embodiment can include the method of any one of the twenty-fourth to twenty-sixth embodiments, wherein, based on the time window, data averaging for each parameter may occur.

A twenty-eighth embodiment can include the method of any one of the nineteenth to twenty-seventh embodiments, wherein applying one or more filtering technique may comprise applying bilateral filtering to the data (e.g. to address oscillations caused by movement of a choke/choke manifold of the drilling system).

A twenty-ninth embodiment can include the method of the twenty-eighth embodiment, wherein bilateral filtering is applied in response to detected drillstring movement and/or adjustment/movement/positioning of the choke manifold (e.g. more than approximately 3%/s).

A thirtieth embodiment can include the method of any one of the nineteenth to twenty-ninth embodiments, wherein applying one or more filtering technique may comprise applying a low pass filter to the data for each parameter.

A thirty-first embodiment can include the method of any one of the nineteenth to thirtieth embodiments, wherein applying one or more filtering technique may comprise addressing a baseline offset.

A thirty-second embodiment can include the method of the thirty-first embodiment, wherein baseline offset may only be addressed in instances in which the flow-in rate is a calculated value (for example, based on mud pump stroke count) instead of directly measured.

A thirty-third embodiment can include the method of the thirty-first or thirty-second embodiment, wherein baseline of flow-out rate and flow-in rate may be updated, for example using filtered flowrate data, and the baselines can then be used to remove the offset.

A thirty-fourth embodiment can include the method of any one of the thirty-first to thirty-third embodiments, wherein the baseline offset can be subtracted out when calculating the flowrate difference (DeltaFR) between flow-out rate and flow-in rate.

A thirty-fifth embodiment can include the method of any one of the thirty-first to thirty-fourth embodiments, further comprising updating and applying baselines (e.g. relating to flow-in rate and flow-out rate) to remove any offset (e.g. which may arise when a calculated value is used for flow-in rate, based on pump stroke counting for example).

A thirty-sixth embodiment can include the method of any one of the first to thirty-fifth embodiments, wherein detecting a possible influx (or loss) comprises comparing a slope of delta flow rate (e.g. difference between flow-out rate and flow-in rate) to the threshold to detect possible influx (or loss—e.g. if negative), wherein influx is detected if the slope is greater than the threshold.

A thirty-seventh embodiment can include the method of any one of the first to thirty-sixth embodiments, wherein confirming detected influx comprises comparing calculated size of influx to detection sensitivity (e.g. confirmation volume), with the influx being confirmed if the size of the influx is greater than the detection sensitivity.

A thirty-eighth embodiment can include the method of any one of the first to thirty-fifth embodiments, wherein detecting and confirming influx (or loss) may comprise: receiving flow-in rate and flow-out rate data (e.g. which may be filtered, for example by adaptive data processing), as well as the detection threshold and the detection sensitivity/confirmation volume (e.g. which may be adaptive based on data quality), detecting potential influx (or loss), and responsive to detection of potential influx (or loss), confirming the detected influx (or loss).

A thirty-ninth embodiment can include the method of the thirty-eighth embodiment, wherein detecting potential influx (or loss) may comprise calculating the flow rate difference (DeltaFR) between flow-out rate and flow-in rate (for example, which may take into account the baseline offset, if any), calculating the slope of DeltaFR (e.g. with respect to time, where DeltaFR=(Flow-Out−Flow-In)−(baseFO−baseFI)), and comparing the slope to the detection threshold. In the event that the slope of DeltaFR is greater than the detection threshold (or less than a negative detection threshold) when making the comparison, a possible influx (or loss) event can be detected.

A fortieth embodiment can include the method of the thirty-eighth or thirty-ninth embodiment, wherein confirming the influx (or loss) may comprise, responsive to detection of a possible influx (or loss), calculating the size of the influx (or loss), for example based on the volume gain between flow-in rate and flow-out rate, and comparing the size of the influx (e.g. volume gain) to the detection sensitivity (e.g. confirmation volume).

A forty-first embodiment can include the method of the fortieth embodiment, wherein in the event that the size of the detected influx (e.g. volume gain) is larger than the detection sensitivity/confirmation volume, the influx event can be confirmed.

A forty-second embodiment can include the method of any one of the first to forty-first embodiments, further comprising, responsive to confirmation, signaling an event (e.g. influx or loss)

A forty-third embodiment can include the method of any one of the first to forty-second embodiments, further comprising (e.g. after detection and confirmation and/or as part of signaling an event) suggesting possible actions or automatically taking one or more action, for example controlling one or more element of the drilling system to address the event.

A forty-fourth embodiment can include the method of the forty-second to forty-third embodiment, further comprise controlling drilling responsive to the signaling, for example in order to control/manage well pressure (BHP) or initiating, for example using one or more controls, corrective actions to control influx/loss.

A forty-fifth embodiment can include the method of the forty-fourth embodiment, wherein controlling drilling may further include using the choke manifold and/or backpressure pump to adjust the backpressure (e.g. which may modify the well pressure, e.g. in the annulus), altering the rate of the mud pump to adjust flow-in rate, circulating out the influx, and/or initiating shut-in procedures (e.g. if the influx is too large to otherwise be controlled and/or circulated out).

In a forty-sixth embodiment, a method for drilling a well can comprise: providing data (e.g. a signal/measurement) relating to one or more parameter of a drilling system (e.g. using one or more sensors which send a signal to the control system), determining the quality/stability of the data for each parameter, thereby determining a health score (e.g. indicative of likely accuracy/quality/stability) for each parameter based on the corresponding stability/quality (which may in some embodiments be scaled so that each parameter health score is set against an equivalent range—for example with the health score for each parameter ranging from zero to 100, with higher scores indicative of more sensitivity), assigning a weight to each parameter (e.g, wherein a parameter receives a weight based on its influence on detecting influx), determining an overall health score based on a weighted sum of the health scores for each parameter (e.g. summing the weighted parameter health scores to determine the overall health score for the influx detection system—e.g. by multiplying each parameter health score by its corresponding weight and then summing the weighted parameter health scores to determine the overall health score), and establishing the threshold to detect influx and the detection sensitivity/confirmation volume (e.g. minimum detectable volume) for confirming influx detection based on the overall health score.

A forty-seventh embodiment can include the method of the forty-sixth embodiment, wherein determining the stability/quality of each parameter comprises evaluating the quality (e.g. amount of stability/fluctuation/noise/oscillation) of the data for that parameter and assigning a score representative of the quality.

A forty-eighth embodiment can include the method of the forty-sixth or forty-seventh embodiment, wherein determining the stability/quality of each parameter may comprise calculating the standard deviation of the data for each parameter in a (e.g. pre-selected) timeframe (e.g. approximately 2 minutes) and using the standard deviation to determine stability/quality.

A forty-ninth embodiment can include the method of any one of the forty-sixth to forty-eighth embodiments, wherein determining the stability/quality of each parameter may comprise using signal-noise-ratio.

A fiftieth embodiment can include the method of any one of the forth-sixth to forty-ninth embodiments, wherein determining a threshold to detect influx and detection sensitivity/confirmation volume may be based on comparison of the overall health score to a look-up table/chart derived from/based upon historical data (e.g. similar to FIG. 3, for example).

A fifty-first embodiment can include the method of any one of the forty-sixth to fiftieth embodiments, wherein the one or more parameter may comprise one or more of the following: flow-in rate, flow-out rate, density, choke position, and drillstring velocity.

A fifty-second embodiment can include the method of any one of the forty-sixth to fifty-first embodiments, further comprising determining a timeframe/window size based on the health score (e.g. stability/quality) of each parameter, and using the timeframe/window to determine an adaptive moving average for each corresponding parameter.

In a fifty-third embodiment, a method for drilling a well can comprise: providing (e.g. measured) flowrate of drilling fluid in a drilling system (e.g. flow rate of fluid exiting the annulus of the well—flow-out rate), providing (e.g. measured) depth data for the drillstring, estimating drillstring velocity (and in some instances acceleration) based on the depth data of the drillstring using a filter, calculating flow-rate variation caused by drillstring movement based on estimated velocity (and in some instances acceleration) of the drillstring and the drillstring outer diameter (e.g. compared to the diameter of the wellbore), and using the calculated flowrate variation from the drillstring to correct the provided flowrate, thereby determining a corrected flowrate.

A fifty-fourth embodiment can include the method of the fifty-third embodiment, wherein the filter for estimating drillstring velocity is a Kalman filter, which may be configured to use position/location (e.g. depth of the drillstring) data to estimate velocity and/or acceleration of the drillstring.

In a fifty-fifth embodiment, a method for drilling a well can comprise: providing (e.g. measured) flowrate of drilling fluid in a drilling system (e.g. flow rate of fluid exiting the annulus of the well-flow-out rate), providing (e.g. measured) drillstring velocity (and in some instances acceleration), calculating flowrate variation caused by drillstring movement based on velocity (and in some instances acceleration) of the drillstring and the drillstring outer diameter (e.g. compared to the diameter of the wellbore), and using the calculated flowrate variation from the drillstring to correct the provided flowrate, thereby determining a corrected flowrate.

A fifty-sixth embodiment can include the method of any one of the fifty-third to fifty-fifth embodiments, further comprising measuring fluid flowrate, wherein measuring fluid flowrate may be performed by a flowmeter (e.g. a Coriolis meter) configured to measure flow rate of fluid out of the well (e.g. in the mud return line).

A fifty-seventh embodiment can include the method of any one of the fifty-third to fifth sixth embodiments, wherein using calculated flowrate variation to correct provided flowrate may comprise subtracting the calculated flowrate variation (e.g. caused by drillstring movement) from the provided (e.g. measured) flowrate.

A fifty-eighth embodiment can include the method of any one of the fifty-third to fifty-seventh embodiments, wherein compensating for drillstring movement (and the associated flowrate change accompanying such movement) may only occur when depth data is changing sufficiently (e.g. indicating that there is drillstring movement).

A fifty-ninth embodiment can include the method of any one of the fifty-third to fifty-eighth embodiments, further comprising filtering parameter data to address oscillations caused by movement of the choke manifold (e.g. when the choke manifold movement is greater than about 3%/s).

In a sixtieth embodiment, a method of drilling a well can comprise receiving data relating to one or more parameter of a drilling system, such as flow-out rate, and applying one or more filtering technique to the data (e.g. to improve the data, for example for better influx detection analysis).

A sixty-first embodiment can include the method of the sixtieth embodiment, wherein applying one or more filter may result in corrected parameter data (e.g. such as corrected flow-out rate).

A sixty-second embodiment can include the method of the sixtieth or sixty-first embodiment, wherein receiving data relating to one or more parameter comprises receiving flow-in rate and/or a health score (e.g. the overall health score) for each parameter (e.g. indicative of the quality of the data for that parameter), in addition to flow-out rate.

A sixty-third embodiment can include the method of the sixtieth or sixty-first embodiment, wherein receiving data relating to one or more parameter comprises receiving one or more of the following: flow-out rate, flow-in rate, density, choke position, drillstring velocity, and overall health scores for the various other relevant parameters.

A sixty-fourth embodiment can include the method of the any one of the sixtieth to sixty-third embodiments, wherein applying one or more filtering technique may comprise using an adaptive moving average technique on the data for each parameter, for example to clean up the signal.

A sixty-fifth embodiment can include the method of the sixty-fourth embodiment, wherein using an adaptive moving average technique may comprise determining a time window size (e.g. timeframe) to use for the adaptive moving average of each parameter based on the health score (e.g. stability/quality) associated with that parameter, and then filtering the data for the corresponding parameter accordingly (e.g. averaging the data for that parameter over the timeframe of the adaptive window).

A sixty-sixth embodiment can include the method of the sixty-fifth embodiment, wherein determining a time window size may comprise using a look-up table/chart (e.g. based on or including historical data) to set the timeframe to use when applying the adaptive moving average technique to data for a parameter, based on the health score for the parameter at issue.

A sixty-seventh embodiment can include the method of the sixty-sixth embodiment, wherein higher health scores lead to smaller timeframe windows, while lower health scores lead to larger timeframe windows (e.g. with timeframe windows ranging from about 1 minute to about 3 minutes).

A sixty-eighth embodiment can include the method of any one of the sixty-fifth to sixty-seventh embodiments, wherein, based on the time window, data averaging for each parameter may occur.

A sixty-ninth embodiment can include the method of any one of the sixtieth to the sixth-eighth embodiments, wherein applying one or more filtering technique may comprise applying bilateral filtering to the data (e.g. to address oscillations caused by movement of a choke manifold of the drilling system).

A seventieth embodiment can include the method of the sixty-ninth embodiment, wherein bilateral filtering is applied responsive to detected drillstring movement and/or adjustment/movement/positioning of the choke manifold (e.g. greater than about 3%/s).

A seventy-first embodiment can include the method of any one of the sixtieth to sixty-ninth embodiments, wherein applying one or more filtering technique may comprise applying a low pass filter to the data for each parameter.

A seventy-second embodiment can include the method of any one of the sixtieth to seventy-first embodiments, wherein applying one or more filtering technique may comprise addressing a baseline offset.

A seventy-third embodiment can include the method of the seventy-second embodiment, wherein baseline offset may only be addressed in instances in which the flow-in rate is a calculated value (for example, based on mud pump stroke count) instead of directly measured.

A seventy-fourth embodiment can include the method of the seventy-second or seventy-third embodiment, wherein the baseline of flow-out rate and flow-in rate may be updated, for example using filtered flowrate data, and the baselines can then be used to remove the offset.

A seventy-fifth embodiment can include the method of any one of the seventh-second to seventy-fourth embodiments, wherein the baseline offset can be subtracted out when calculating the flowrate difference (DeltaFR) between flow-out rate and flow-in rate.

A seventy-sixth embodiment can include the method of any one of the seventy-second to seventy-fifth embodiments, further comprising updating and applying baselines (e.g. relating to flow-in rate and flow-out rate) to remove any offset (e.g. which may arise when a calculated value is used for flow-in rate, based on pump stroke counting for example).

In a seventy-seventh embodiment, a method of drilling a well can comprise: receiving flow-in rate and flow-out rate data relating to an MPD drilling system (e.g. which may be filtered, for example by adaptive data processing), as well as detection threshold and detection sensitivity/confirmation volume data (e.g. which may be adaptive, based on data quality), detecting potential influx (or loss), and responsive to detection of a potential influx (or loss), confirming the detected influx (or loss).

A seventy-eighth embodiment can include the method of the seventy-seventh embodiment, wherein detecting potential influx (or loss) may comprise calculating the flow rate difference (DeltaFR) between flow-out rate and flow-in rate (for example, which may take into account the baseline offset, if any), calculating the slope of DeltaFR (e.g. with respect to time, where DeltaFR=(Flow-Out−Flow-In)−(baseFO−baseFI)), and comparing the slope to the detection threshold. In the event that the slope of DeltaFR is greater than the detection threshold (or less than a negative detection threshold) when making the comparison, a possible influx (or loss) event can be detected.

A seventy-ninth embodiment can include the method of the seventy-seventh or seventy-eighth embodiment, wherein confirming the influx (or loss) may comprise, responsive to detection of a possible influx (or loss), calculating the size of the influx (or loss), for example based on the volume gain between flow-in rate and flow-out rate, and comparing the size of the influx (e.g. volume gain) to the detection sensitivity (e.g. confirmation volume).

An eightieth embodiment can include the method of the seventy-ninth embodiment, wherein in the event that the size of the detected influx (e.g. volume gain) is larger than the detection sensitivity/confirmation volume, the influx event can be confirmed.

An eighty-first embodiment can include the method of any one of the seventy-seventh to eightieth embodiments, further comprising, responsive to confirmation, signaling an event (e.g. influx or loss).

An eighty-second embodiment can include the method of any one of the seventy-seventh to eighty-first embodiments, further comprising (e.g. after detection and confirmation and/or as part of signaling) suggesting possible actions or automatically taking one or more action, for example controlling one or more element of the drilling system to address the event.

An eighty-third embodiment can include the method of any one of the seventy-seventh to eighty-second embodiments, further comprise controlling drilling responsive to the signaling, for example in order to control/manage well pressure (BHP).

An eighty-fourth embodiment can include the method of any one of the seventy-seventh to eighty-third embodiments, wherein controlling drilling may include initiating, for example using one or more controls, corrective actions to control influx/loss.

An eighty-fifth embodiment can include the method of any one of the seventy-seventh to eighty-fourth embodiments, further comprising controlling drilling (e.g. responsive to detection, confirmation, or signaling of influx; using filtered data; based on corrected flowrate which accounts for oscillations from choke movement, based on the (adaptive) threshold to detect influx and detection sensitivity; and/or based on corrected flowrate which accounts for drillstring movement.

An eighty-sixth embodiment can include the method of the eighty-fifth embodiment, wherein controlling drilling comprises controlling/managing well pressure (BHP).

An eighty-seventh embodiment can include the method of the eighty-fifth embodiment, wherein controlling drilling comprises initiating, using one or more controls, corrective actions to control influx/loss.

An eighty-eighth embodiment can include the method of the eighty-fifth embodiment, wherein controlling drilling comprises adjusting the choke manifold and/or back-pressure pump, or initiating or signaling shut-in procedure.

In an eighty-ninth embodiment, a system for drilling a well can comprise a control unit/system (e.g. having a processor) configured to implement the method of any one of the first to eighty-eighth embodiments.

A ninetieth embodiment can include the system of the eighty-ninth embodiment, further comprising a drillstring disposed in a wellbore, an RCD configured to seal an annulus of the wellbore (e.g. between the drillstring and the sidewall of the wellbore), a choke manifold in fluid communication with the annulus (e.g. through the RCD), and a mud pump in fluid communication with the choke manifold and the drillstring.

A ninety-first embodiment can include the system of the ninetieth embodiment, further comprising a drilling fluid handling system in fluid communication with both the choke manifold and the mud pump.

A ninety-second embodiment can include the system of the ninetieth or ninety-first embodiments, further comprising a back-pressure pump configured to apply backpressure to the annulus.

A ninety-third embodiment can include the system of any one of the eighty-ninth to ninety-second embodiments, further comprising one or more sensors (e.g. configured to sense one or more of flow-out rate, flow-in rate, pump stroke count, pressure, density, choke position, drillstring position, drillstring velocity, temperature, etc.).

In a ninety-fourth embodiment, a programmable storage device (e.g. non-transitory computer-readable medium) having program instructions stored thereon for causing a programmable control device (e.g. a processor) to perform (e.g. when executed by a processor) a method according to any one of the first to eighty-eighth and ninety-fifth to ninety-eighth embodiments.

In a ninety-fifth embodiment, an MPD method for drilling a well using a drilling system can comprise: drilling a wellbore, including circulating fluid through the wellbore during drilling; monitoring, using one or more sensors, one or more parameters associated with drilling the wellbore selected from the following: flow-in rate, flow-out rate, density, choke position, and drillstring velocity; determining, using a processor, a threshold for detection of an influx and a detection sensitivity based on quality of data for the one or more parameters; detecting, using the processor, a potential influx using the detection threshold; confirming, using the processor, the detected influx using the detection sensitivity; and responsive to confirming the detected influx, initiating an action in the drilling system.

A ninety-sixth embodiment can include the method of the ninety-fifth embodiment, further comprising the method of any one of the second to forty-fifth embodiments.

In a ninety-seventh embodiment, a method for drilling a well using a drilling system can comprise: receiving, at a control system, data relating to one or more parameters of the drilling system; determining, using the control system, a threshold for detection of an influx and a detection sensitivity based on quality of data for the one or more parameters; detecting, using the control system, a potential influx using the threshold; confirming, using the control system, the detected influx using the detection sensitivity; and responsive to confirming the detected influx, initiating an action in the drilling system; wherein determining a threshold for detection of an influx and a detection sensitivity further comprises: determining stability/quality of the data for each parameter, thereby determining a health score for each parameter based on the stability/quality; assigning a weight to each parameter; determining an overall health score based on a weighted sum of the health scores for the one or more parameters; and establishing the threshold to detect influx and the detection sensitivity for confirming influx detection based on the overall health score.

A ninety-eighth embodiment can include the method of the ninety-seventh embodiment, further comprising the method of any one of the forty-sixth to fifty-second embodiments.

In a ninety-ninth embodiment, a method for identifying/detecting potential fluid losses or gains in a (e.g. managed pressure) drilling system or a method for drilling a well using a (e.g. managed pressure) drilling system can comprise: providing data or receiving data (e.g. at a control system/processor) relating to one or more parameter of the drilling system (e.g. using one or more sensors which send a signal/measurement to the control system); using/applying (e.g. by the control system/processor) an adaptive moving average technique on the data for one or more such parameter to provide filtered/corrected data (e.g. to clean up the signal by removing noise); using the filtered/corrected data, calculating (e.g. by the control system/processor) the flow-rate difference (DeltaFR) between flow-out rate and flow-in rate; and detecting/estimating possible fluid losses or gains by calculating (e.g. using the control system/processor) a virtual trip tank using DeltaFR (e.g. based on $VTT=\Sigma(DeltaFR)\times\Delta t$, wherein DeltaFR=(Flow-Out Rate−Flow-In Rate) or if baseline offset is used, DeltaFR=(Flow-Out−Flow-In)−(baseFO−baseFI)).

A one hundredth embodiment can include the method of the ninety-ninth embodiment, wherein in the event that VTT is positive, fluid gain is detected/estimated, and/or in the event that VTT is negative, fluid loss is detected/estimated.

A one hundred first embodiment can include the method of any one of the ninety-ninth to one hundredth embodiments, wherein the one or more parameter comprises one or more of the following: flow-in rate, flow-out rate, density, choke position, and/or drillstring velocity (one or more of which may be monitored by one or more sensor). In some embodiments, the adaptive moving average technique may be applied to flow-in rate and/or flow-out-rate (e.g. perhaps only flow-out rate, if flow-in is calculated rather than measured, in some embodiments).

A one hundred second embodiment can include the method of any one of the ninety-ninth to one hundred-first embodiments, wherein using/applying an adaptive moving average technique comprises: determining/evaluating (e.g. using the control system/processor) the stability/quality of the data for each relevant parameter (e.g. to determine a window size for the data for the one or more of such parameter); determining (e.g. using the control system/processor) a timeframe/window size based on the stability/quality of the data each such parameter; and using the timeframe/window to determine an adaptive moving average for the data relating to each corresponding parameter.

A one hundred third embodiment can include the method of the one hundred second embodiment, wherein, based on the timeframe/window, data averaging of the data for each corresponding parameter occurs.

A one hundred fourth embodiment can include the method of any one of the one hundred second to one hundred third embodiments, wherein using the timeframe/window to determine an adaptive moving average comprises averaging the data for each such parameter over the timeframe of the adaptive window.

A one hundred fifth embodiment can include the method of any one of the one hundred second to one hundred fourth embodiments, wherein determining a timeframe/window size comprises using a look-up table/chart (e.g. based on or having historical data) to set the size of the time window to use when applying the adaptive moving average technique to data for a parameter, based on the evaluation of stability/quality of the data for the parameter at issue (e.g, wherein the table/chart correlates stability to a timeframe/window size based on historical data).

A one hundred sixth embodiment can include the method of any one of the one hundred second to one hundred fifth embodiments, wherein more stable/higher quality data associated with such parameter lead to smaller timeframe windows, while less stable/lower quality data lead to larger timeframe windows (e.g. with timeframe windows ranging from about 1 minute to about 3 minutes, depending on the stability/quality (e.g. which may be set forth in a health score in some embodiments)).

A one hundred seventh embodiment can include the method of any one of the one hundred second to one hundred sixth embodiments, wherein determining the stability/quality of the data (e.g. associated with each such parameter) comprises evaluating the quality (e.g. amount of stability/fluctuation/noise/oscillation) of the data for that parameter and assigning a score representative of the stability/quality.

A one hundred eighth embodiment can include the method of any one of the one hundred second to one hundred seventh embodiments, wherein determining the stability/quality of data for each parameter comprises calculating the standard deviation of the data for each parameter in a (e.g. pre-selected) timeframe (e.g. approximately 2 minutes in some embodiments) and using the standard deviation to determine stability/quality (e.g. with greater standard deviation indicative of less stability/lower quality, and lower standard deviation indicative of more stability/higher quality).

A one hundred ninth embodiment can include the method of any one of the one hundred second to one hundred eighth embodiments, wherein determining the stability/quality of each parameter comprises using a signal-noise-ratio.

A one hundred tenth embodiment can include the method of any one of the ninety-ninth to one hundred ninth embodiments, further comprising compensating for drillstring movement (e.g. the impact of drillstring movement on flowrate data, such as flow-out rate).

A one hundred eleventh embodiment can include the method of the one hundred tenth embodiment, wherein compensating for drillstring movement comprises subtracting flowrate attributable to drillstring movement from measured fluid flowrate (e.g. out of the well-flow-out rate).

A one hundred twelfth embodiment can include the method of any one of the one hundred tenth to one hundred eleventh embodiments, wherein compensating for drillstring movement may comprise: providing (e.g. measured) flow-rate of drilling fluid in a drilling system (e.g. flow rate of fluid exiting the annulus of the well-flow-out rate), providing (e.g. measured) depth data for the drillstring, estimating drillstring velocity (and in some instances acceleration)

based on the depth data of the drillstring using a filter, calculating flowrate variation caused by drillstring movement based on estimated velocity (and in some instances acceleration) of the drillstring and the drillstring outer diameter (e.g. compared to the diameter of the wellbore), and using the calculated flowrate variation from the drillstring to correct the provided (e.g. measured) flowrate, thereby determining a corrected flowrate.

A one hundred thirteenth embodiment can include the method of the one hundred twelfth embodiment, wherein the filter for estimating drillstring velocity is a Kalman filter, which may be configured to use position/location (e.g. depth of the drillstring) data to estimate velocity and/or acceleration of the drillstring.

A one hundred fourteenth embodiment can include the method of any one of the one hundred tenth to one hundred eleventh embodiments, wherein measured drillstring velocity may be used in the evaluation (e.g. instead of estimating the velocity based on depth data).

A one hundred fifteenth embodiment can include the method of any one of the one hundred tenth to one hundred fourteenth embodiments, further comprising measuring fluid flowrate, wherein measuring fluid flowrate may be performed by a flowmeter (e.g. a Coriolis meter) configured to measure flow rate of fluid out of the well (e.g. in the mud return line of the drilling system).

A one hundred sixteenth embodiment can include the method of any one of the one hundred twelfth to one hundred fifteenth embodiments, wherein using calculated flowrate variation to correct provided/measured flowrate may comprise subtracting the calculated flowrate variation (e.g. caused by drillstring movement) from the provided (e.g. measured) flowrate (e.g. to determine corrected flowrate).

A one hundred seventeenth embodiment can include the method of any one of the one hundred tenth to one hundred sixteenth embodiments, wherein compensating for drillstring movement (and the associated flowrate change accompanying such movement) may only occur when depth data is changing sufficiently (e.g. beyond a pre-set threshold, which may indicate that there is drillstring movement—e.g. not just noise).

A one hundred eighteenth embodiment can include the method of any one of the one hundred tenth to one hundred seventeenth embodiments, wherein in the event of phase delay/time shift (e.g. when compensating flow rate with Kalman filter estimation based on depth data), for example caused by communication and filtering (e.g. time shift between actual occurrence and measurement/display), estimating the phase delay/time shift (e.g. on the depth data) (e.g. using fingerprint testing) and correcting for the phase shift/time delay (e.g. time shifting the data accordingly (e.g. by subtracting it out)).

A one hundred nineteenth embodiment can include the method of the one hundred eighteenth embodiment, wherein estimating the phase delay/time shift comprises calibrating the system to determine the amount of phase delay/time shift (e.g. though experimental observation/testing).

A one hundred twentieth embodiment can include the method of any one of the one hundred tenth to one hundred nineteenth embodiments, wherein before drilling (e.g. during run-in of the drillstring), spending time (e.g. approx. 1 hour) doing calibration testing (e.g. fingerprint testing, for example moving the drillstring within the well and observing the delay before detection using the sensors and/or calculation) to get delay time from action to detection (e.g. the estimated amount of phase shift).

A one hundred twenty-first embodiment can include the method of any one of the one hundred nineteenth to one hundred twentieth embodiments, wherein accounting for the phase delay/time shift comprises subtracting estimated phase shift (e.g. from earlier testing) to correct the data (e.g. correction in real-time).

A one hundred twenty-second embodiment can include the method of any one of the one hundred-nineteenth to one hundred twenty-first embodiments, wherein phase delay/time shifting is conducted before subtracting flow rate fluctuation (e.g. estimated using Kalman filter), for example applying phase delay to measured depth data or to calculated velocity data.

A one hundred twenty-third embodiment can include the method of any one of the one hundred tenth to one hundred twenty-second embodiments, further comprising prior to drilling and/or prior to applying adaptive moving average technique, determining if there is any phase delay/time shifting (e.g. with respect to flow-out rate in the system); and in the event of any phase delay/time shifting, accounting for phase delay/time shifting (e.g. prior to using calculated flowrate variation to correct the provided flowrate, for example prior to subtracting flow rate fluctuation from drillstring movement out of flow-out rate).

A one hundred twenty-fourth embodiment can include the method of any one of the ninety-ninth to one hundred twenty-third embodiments, further comprising filtering parameter data (e.g. flow-out rate and/or flow-in rate) to remove oscillations caused by movement of the choke manifold.

A one hundred twenty-fifth embodiment can include the method of the one hundred twenty-fourth embodiment, wherein filtering parameter data to remove oscillations may only occur if choke manifold movement is greater than approximately 3%/s.

A one hundred twenty-sixth embodiment can include the method of any one of the one hundred twenty-fourth to one hundred twenty-fifth embodiments, wherein filtering data to remove oscillation may comprise applying bilateral filtering to the data (e.g. to address oscillations caused by movement of a choke/choke manifold of the drilling system).

A one hundred twenty-seventh embodiment can include the method of the one hundred twenty-sixth embodiment, wherein bilateral filtering is applied in response to detected drillstring movement and/or adjustment/movement/positioning of the choke manifold (e.g. more than approximately 3%/s).

A one hundred twenty-eight embodiment can include the method of any one of the ninety-ninth to the one hundred twenty-seventh embodiments, further comprising addressing any baseline offset.

A one hundred twenty-ninth embodiment can include the method of the one hundred twenty-eighth embodiments, wherein baseline offset may only be addressed in instances in which the flow-in rate is a calculated value (for example, based on mud pump stroke count) instead of directly measured.

A one hundred thirtieth embodiment can include the method of any one of the ninety-ninth to the one hundred twenty-ninth embodiments, wherein baseline of flow-out rate and flow-in rate may be updated, for example using filtered/corrected flowrate data, and the baselines can then be used to remove the offset.

A one hundred thirty-first embodiment can include the method of any one of the ninety-ninth to the one hundred-thirtieth embodiments, wherein the baseline offset can be subtracted out when calculating the flowrate difference (DeltaFR) between flow-out rate and flow-in rate.

A one hundred thirty-second embodiment can include the method of any one of the ninety-ninth to the one hundred thirty-first embodiments, further comprising updating and applying baselines (e.g. relating to flow-in rate and/or flow-out rate) to remove any offset (e.g. which may arise when a calculated value is used for flow-in rate, based on pump stroke counting for example).

A one hundred thirty-third embodiment can include the method of any one of the ninety-ninth to the one hundred thirty-second embodiments, wherein calculating (e.g. by the control system/processor) the flowrate difference (DeltaFR) between flow-out rate and flow-in rate may take into account the baseline offset (e.g. DeltaFR=(Flow-Out−Flow-In)−(baseFO−baseFI)).

A one hundred thirty-fourth embodiment can include the method of any one of the ninety-ninth to the one hundred thirty-third embodiments, further comprising drilling a wellbore, including circulating fluid through the wellbore during drilling; and monitoring, using one or more sensors, one or more parameters associated with drilling the wellbore (e.g. flow-in rate, flow-out rate, density, choke position, and/or drillstring velocity).

A one hundred thirty-fifth embodiment can include the method of any one of the ninety-ninth to the one hundred thirty-fourth embodiments, further comprising, responsive to detecting gain/loss (e.g. beyond a threshold), initiating an action in the drilling system (e.g. suggesting possible actions or automatically taking one or more action, for example controlling one or more element of the drilling system to address the detected event).

A one hundred thirty-sixth embodiment can include the method of the one hundred thirty-fifth embodiment, wherein initiating an action comprises: altering one or more aspect of the system (e.g. pump rate, BHP, backpressure, etc.) accordingly (e.g. to address detected gain or loss); signaling an event (e.g. gain or loss); and/or controlling drilling (e.g. responsive to the signaling), for example in order to control/manage well pressure (BHP).

A one hundred thirty-seventh embodiment can include the method of the one hundred thirty-sixth embodiment, wherein controlling drilling may include initiating, for example using one or more controls, corrective actions to control influx/loss.

A one hundred thirty-eighth embodiment can include the method of the one hundred thirty-sixth or one hundred thirty-seventh embodiment, wherein controlling drilling may include using the choke manifold and/or back-pressure pump to adjust the backpressure (e.g. which may modify the well pressure, e.g. in the annulus), altering the rate of the mud pump to adjust flow-in rate, circulating out the influx, and/or initiating shut-in procedures (e.g. if the influx is too large to otherwise be controlled and/or circulated out).

In a one hundred thirty-ninth embodiment, a method (e.g. for identifying/detecting/estimating potential fluid losses or gains in a (e.g. managed pressure) drilling system (e.g. for use drilling a well) or a method for drilling a well) can comprise: providing data (e.g. a signal/measurement) relating to one or more parameter of the drilling system (e.g. using one or more sensors which send a signal to the control system); filtering/correcting parameter data (e.g. such as flow-out rate and/or flow-in rate data) (e.g. applying one or more filtering/correcting technique to the data; using the filtered/corrected data to calculate the flowrate difference (DeltaFR) between flow-out rate and flow-in rate; and detecting/estimating possible fluid losses or gains in the system by calculating a virtual trip tank using DeltaFR (e.g. based on VTT=Σ(DeltaFR)×Δt, wherein DeltaFR=(Flow-Out Rate−Flow-In Rate)).

A one hundred fortieth embodiment can include the method of the one hundred thirty-ninth embodiment, wherein the data relating to one or more parameter comprises: flow-out rate, flow-in rate, density, choke position, and/or drillstring velocity.

A one hundred forty-first embodiment can include the method of the one hundred-thirty-ninth or one hundred-fortieth embodiment, wherein filtering/correcting parameter data comprises applying one or more filtering technique, for example using one or more of the following: an adaptive moving average technique (for example to clean up the signal by removing noise); a bilateral filtering technique (e.g. to address oscillations caused by movement of a choke/choke manifold of the drilling system); a low pass filter technique; addressing a baseline offset; and/or compensating for drillstring movement (e.g. filtering for estimating drillstring velocity using a Kalman filter, which may be configured to use position/location (e.g. depth of the drillstring) data to estimate velocity and/or acceleration of the drillstring, in order to then subtract out the flow due to drillstring movement).

A one hundred forty-second embodiment can include the method of any one of the one hundred thirty-ninth to one hundred forty-first embodiments, wherein applying one or more filter may result in corrected parameter data (e.g. such as corrected flow-out rate).

A one hundred forty-third embodiment can include the method of any one of the one hundred forty-first or one hundred forty-second embodiments, wherein applying the adaptive moving average technique comprises: evaluating signal quality for the data; determining a time window for averaging the data based on signal quality; and averaging the data for that parameter across the time window (e.g. a sliding time window whose size changes adaptively based on the signal quality for the data at issue).

A one hundred forty-fourth embodiment can include the method of any one of the ninety-ninth to one hundred forty-third embodiments, wherein the VTT calculation/estimate and analysis (e.g. any one of embodiments ninety-nine to one hundred forty-three) occurs in response to early detection of influx (e.g. EKD, see for example any one of embodiments one through ninety-eight).

A one hundred forty-fifth embodiment can include the method of the one hundred forty-fourth embodiment, wherein the VTT calculation/estimate is used to verify/confirm early detection of influx (e.g. EKD).

A one hundred forty-sixth embodiment can include the method of any one of the first to ninety-eighth embodiments, further comprising performing (e.g. using corrected data, for example flow-in rate and/or flow-out rate) VTT calculation and analysis (see for example embodiments ninety-nine through one-hundred forty-three).

In a one hundred forty-seventh embodiment, an MPD system for drilling a wellbore, can comprise: a control unit/system (e.g. having a processor) configured to implement the method of any one of the first to one hundred forty-sixth embodiments.

A one hundred forty-eighth embodiment can include the system of the one hundred forty-seventh embodiment, further comprising a drillstring disposed in a wellbore, an RCD configured to seal an annulus of the wellbore (e.g. between the drillstring and the sidewall of the wellbore), a choke manifold in fluid communication with the annulus (e.g.

through the RCD), and/or a mud pump in fluid communication with the choke manifold and the drillstring.

A one hundred forty-ninth embodiment can include the system of any one of the one hundred forty-seventh to one hundred forty-eighth embodiments, further comprising a drilling fluid handling system (e.g. trip tank) in fluid communication with both the choke manifold and the mud pump.

A one hundred fiftieth embodiment can include the system of any one of the one hundred forty-seventh to one hundred forty-ninth embodiments, further comprising a back-pressure pump configured to apply backpressure to the annulus.

A one hundred fifty-first embodiment can include the system of any one of the one hundred forty-seventh to one hundred fiftieth embodiments, further comprising one or more sensors (e.g. configured to sense one or more of flow-out rate, flow-in rate, pump stroke count, pressure, density, choke position, drillstring position, drillstring velocity, temperature, etc.).

In a one hundred fifty-second embodiment, a programmable storage device (e.g. non-transitory computer-readable medium) having program instructions stored thereon for causing a programmable control device (e.g. a processor) to perform (e.g. when executed by the processor) a method according to any one of the first to one hundred forty-sixth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A method for drilling a well using a managed pressure drilling system, comprising:

drilling a wellbore with a drillstring, including circulating fluid through the wellbore during drilling;

receiving, at a control system, data from one or more sensor relating to one or more parameter of the drilling system;

applying, by the control system, an adaptive moving average technique on the data to provide corrected data;

calculating, by the control system using the corrected data, a flowrate difference (DeltaFR) between flow-out rate and flow-in rate;

compensating for drillstring movement, wherein compensating for drillstring movement comprises:

providing flowrate of drilling fluid in a drilling system;

providing depth data for the drillstring;

estimating drillstring velocity based on the depth data of the drillstring using a filter;

calculating flowrate variation caused by drillstring movement based on estimated velocity and the drillstring outer diameter; and using the calculated flowrate variation to correct the provided flowrate, wherein the filter for estimating drillstring velocity is a Kalman filter detecting possible fluid losses or gains by calculating, using the control system, a virtual trip tank using DeltaFR; and responsive to detecting possible fluid losses or gains, initiating an action in the drilling system to address detected fluid losses or gains, wherein initiating an action comprises altering one of the following in the drilling system: bottom hole pressure, backpressure, pump rate, or combinations thereof.

2. The method of claim 1, wherein calculating the virtual trip tank (VTT) is based on $VTT=\Sigma(DeltaFR)\times\Delta t$.

3. The method of claim 1, wherein applying an adaptive moving average technique comprises:

evaluating quality of the data;

determining a timeframe based on the quality of the data; and using the timeframe to determine an adaptive moving average for the data.

4. The method of claim 3, wherein using the timeframe to determine an adaptive moving average comprises averaging the data over the timeframe.

5. The method of claim 3 wherein evaluating the quality of the data comprises calculating a standard deviation of the data in a pre-selected timeframe, and using the standard deviation to determine quality.

6. The method of claim 1, wherein compensating for drillstring movement comprises subtracting flowrate attributable to drillstring movement from measured fluid flowrate.

7. The method of claim 1, further comprising, prior to applying an adaptive moving average technique, determining any phase delay; and in the event of phase delay, accounting for phase delay prior to using the calculated flowrate variation to correct the provided flowrate.

8. The method of claim 1, further comprising updating and applying baselines to remove any offset.

9. The method of claim 1, wherein calculating the flowrate difference (DeltaFR) takes into account baseline offset.

10. The method of claim 1, further comprising monitoring, using one or more sensors, the one or more parameter including flow-in rate, flow-out rate, density, choke position, and/or drillstring velocity.

11. The method of claim 1, further comprising, responsive to detecting fluid gains beyond capacity of the system, initiating shut-in of the system.

12. The method of claim 1, further comprising, responsive to detecting fluid gains within capacity of the system, circulating the fluid gain out of the system.

13. The method of claim 1, further comprising adjusting a choke manifold, a backpressure pump, a mud pump, or combinations thereof.

14. A method for drilling a well using a managed pressure drilling system, comprising:

drilling a wellbore with a drillstring, including circulating fluid through the wellbore during drilling;

receiving, at a control system, data from one or more sensor relating to one or more parameter of the drilling system;

applying, by the control system, an adaptive moving average technique on the data to provide corrected data;

calculating, by the control system using the corrected data, a flowrate difference (DeltaFR) between flow-out rate and flow-in rate;

detecting possible fluid losses or gains by calculating, using the control system, a virtual trip tank using DeltaFR; and responsive to detecting possible fluid losses or gains, initiating an action in the drilling system to address detected fluid losses or gains, wherein initiating an action comprises altering one of the following in the drilling system: bottom hole pressure, backpressure, pump rate, or combinations thereof;

further comprising filtering parameter data to remove oscillations caused by movement of a choke manifold, wherein filtering data to remove oscillation comprises applying bilateral filtering to the data.

15. The method of claim 14, further comprising updating and applying baselines to remove any offset, wherein calculating the flowrate difference (DeltaFR) takes into account baseline offset.

16. The method of claim 14, further comprising compensating for drillstring movement.

17. A system for drilling a wellbore, comprising:

a control system configured to implement the method of claim 1; and a drillstring disposed in the wellbore.

18. The system of claim 17, further comprising an RCD configured to seal an annulus of the wellbore, a choke manifold in fluid communication with the annulus, and a mud pump in fluid communication with the choke manifold and the drillstring.

19. The system of claim 18, further comprising:

a drilling fluid handling system in fluid communication with both the choke manifold and the mud pump;

a back-pressure pump configured to apply backpressure to the annulus; and one or more sensors.

* * * * *